US011060285B2

(12) United States Patent
Forsland

(10) Patent No.: US 11,060,285 B2
(45) **Date of Patent: *Jul. 13, 2021**

(54) BUILDING STRUCTURE HAVING A ROOF THAT IS CONVERTIBLE BETWEEN OPEN AND CLOSED CONFIGURATIONS

(71) Applicant: CONVERTIBLE LIVING LLC, River Falls, WI (US)

(72) Inventor: Kent Harry Forsland, River Falls, WI (US)

(73) Assignee: Convertible Living LLC, River Falls, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/214,831

(22) Filed: Dec. 10, 2018

(65) Prior Publication Data

US 2019/0376284 A1 Dec. 12, 2019

Related U.S. Application Data

(63) Continuation of application No. 14/364,479, filed as application No. PCT/US2012/069241 on Dec. 12, 2012, now Pat. No. 10,151,109.

(60) Provisional application No. 61/569,610, filed on Dec. 12, 2011.

(51) Int. Cl.

| | |
|---|---|
| ***E04B 7/20*** | (2006.01) |
| ***E04B 7/16*** | (2006.01) |
| *E04B 1/343* | (2006.01) |

(52) U.S. Cl.
CPC ..... *E04B 7/166* (2013.01); *E04B 7/16* (2013.01); *E04B 1/343* (2013.01); *E04B 7/163* (2013.01); *E04B 7/20* (2013.01)

(58) Field of Classification Search
CPC . E04B 7/16; E04B 1/343; E04B 7/163; E04B 7/20; E04B 7/166
See application file for complete search history.

(56) References Cited

U.S. PATENT DOCUMENTS

| | | | | | |
|---|---|---|---|---|---|
| 2,094,801 | A | * | 10/1937 | Mass | E04B 7/166 52/64 |
| 3,589,084 | A | * | 6/1971 | Reed, III | E04B 1/342 52/64 |
| 4,528,785 | A | * | 7/1985 | de Jager | E04B 7/166 52/66 |
| 4,616,451 | A | * | 10/1986 | Glick | E04B 7/166 49/125 |
| 4,783,861 | A | * | 11/1988 | Leurent | A01G 9/1469 4/498 |
| 5,778,603 | A | * | 7/1998 | Reppas | E04B 7/166 52/6 |
| 5,829,204 | A | * | 11/1998 | Lonnberg | E04B 7/166 52/66 |
| 6,138,417 | A | * | 10/2000 | Woodard | E04B 7/166 160/202 |

(Continued)

*Primary Examiner* — Phi D A
(74) *Attorney, Agent, or Firm* — Merchant & Gould P.C.

(57) ABSTRACT

The present disclosure relates to a building structure having a convertible roof with at least one moveable roof section. The moveable roof section can include an integrated overhang. The moveable roof section can also include a roller that rides on a track formed by an angle member. The convertible roof can further have a configuration that reduces rafter visibility.

18 Claims, 36 Drawing Sheets

(56) References Cited

U.S. PATENT DOCUMENTS

| | | | | |
|---|---|---|---|---|
| 8,256,166 | B2 * | 9/2012 | Lonnberg | E04B 7/166 52/66 |
| 8,381,452 | B1 * | 2/2013 | Forsland | E04B 7/166 4/494 |
| 8,661,575 | B2 * | 3/2014 | Chapus | E04H 4/086 4/498 |
| 2008/0134588 | A1 * | 6/2008 | Knight | E04B 1/34815 52/66 |
| 2011/0036021 | A1 * | 2/2011 | Lonnberg | E04B 7/166 52/64 |

* cited by examiner

BUILDING STRUCTURE HAVING A ROOF THAT IS CONVERTIBLE BETWEEN OPEN AND CLOSED CONFIGURATIONS

This application is a Continuation of U.S. patent application Ser. No. 14/364,479, filed Jun. 11, 2014, now U.S. Pat. No. 10,151,109, which is a National Stage Application of PCT/US2012/069241, filed Dec. 12, 2012, which claims benefit of U.S. Provisional Application Ser. No. 61/569,610, filed Dec. 12, 2011, and which applications are incorporated herein by reference. To the extent appropriate, a claim of priority is made to each of the above disclosed applications.

TECHNICAL FIELD

The present disclosure relates generally to building structures. More particularly, the present disclosure relates to building structures that are convertible between open and closed configurations.

BACKGROUND

Building structures have been developed including roofs that are convertible between open configurations and closed configurations. Such building structures can provide robust, architecturally pleasing alternatives to less permanent structures, such as tents. Example building structures having roofs that are convertible between open and closed configurations can be used to cover patios, pools or other areas to make the areas more usable. In the case of a restaurant, a convertible building structure allows patio space to be used for open air dining during fair weather conditions, while concurrently allowing the patio space to be used for enclosed dining during inclement weather conditions and during the winter. Thus, by adding a convertible building structure, a restaurant can increase the year-round dining capacity of the restaurant without sacrificing the ability to provide desirable outdoor seating during favorable weather conditions. United States Patent Application Publication No. US 2012/0000141 discloses an example convertible building structure.

SUMMARY

One aspect of the present disclosure relates to a building structure with a convertible roof having an integrated overhang configuration that eliminates the need for gutters.

Another aspect of the present disclosure relates to a convertible roof for a building structure. The convertible roof includes first and second roof sections. At least the first roof section is moveable relative to the second roof section. In one example, the first roof section rides on a track that extends over the second roof section.

A further aspect of the present disclosure relates to a building structure having a roof that is convertible between an open configuration and a closed configuration. The roof includes a moveable roof section mounted on a track formed by an angle member. The moveable roof section can include a roller that rides on a peak of the angle member. The moveable roof section can include a hold-down bracket having a portion that extends under the angle member to prevent the roof section from being lifted from the track by wind.

A further aspect of the present disclosure relates to a building structure having a roof that is convertible between an open configuration and a closed configuration. The roof includes first and second roof sections. At least the first roof section is moveable relative to the second roof section. The first and second roof sections include main supports in the form of rafters. In certain examples, rafters of the first and second roof sections can align at overlap regions to reduce visibility of the rafters. Reducing visibility of the rafters can enhance the aesthetic appearance of the building structure. In the case where the roof sections have light transmissive panels, the use of overlapping rafters can allow more light to enter the space enclosed by the building structure.

A variety of additional aspects will be set forth in the description that follows. The aspects can relate to individual features and to combinations of features. It is to be understood that both the foregoing general description and the following detailed description are exemplary and explanatory only and are not restrictive of the broad concepts upon which the examples disclosed herein are based.

DETAILED DESCRIPTION

Certain aspects of the present disclosure relate to building structures having roofs that are convertible between open configurations and closed configurations. In certain embodiments, the convertible roofs have overhangs that project outwardly from the building structure in a direction generally perpendicular to a direction in which roof sections of the roof slide. In other embodiments, slideable roof sections are supported on tracks that are in turn supported on adjacent roof sections. In further embodiments, slideable roof sections are supported on tracks positioned directly above adjacent roof sections over which the slideable roof sections slide.

Figure 1:
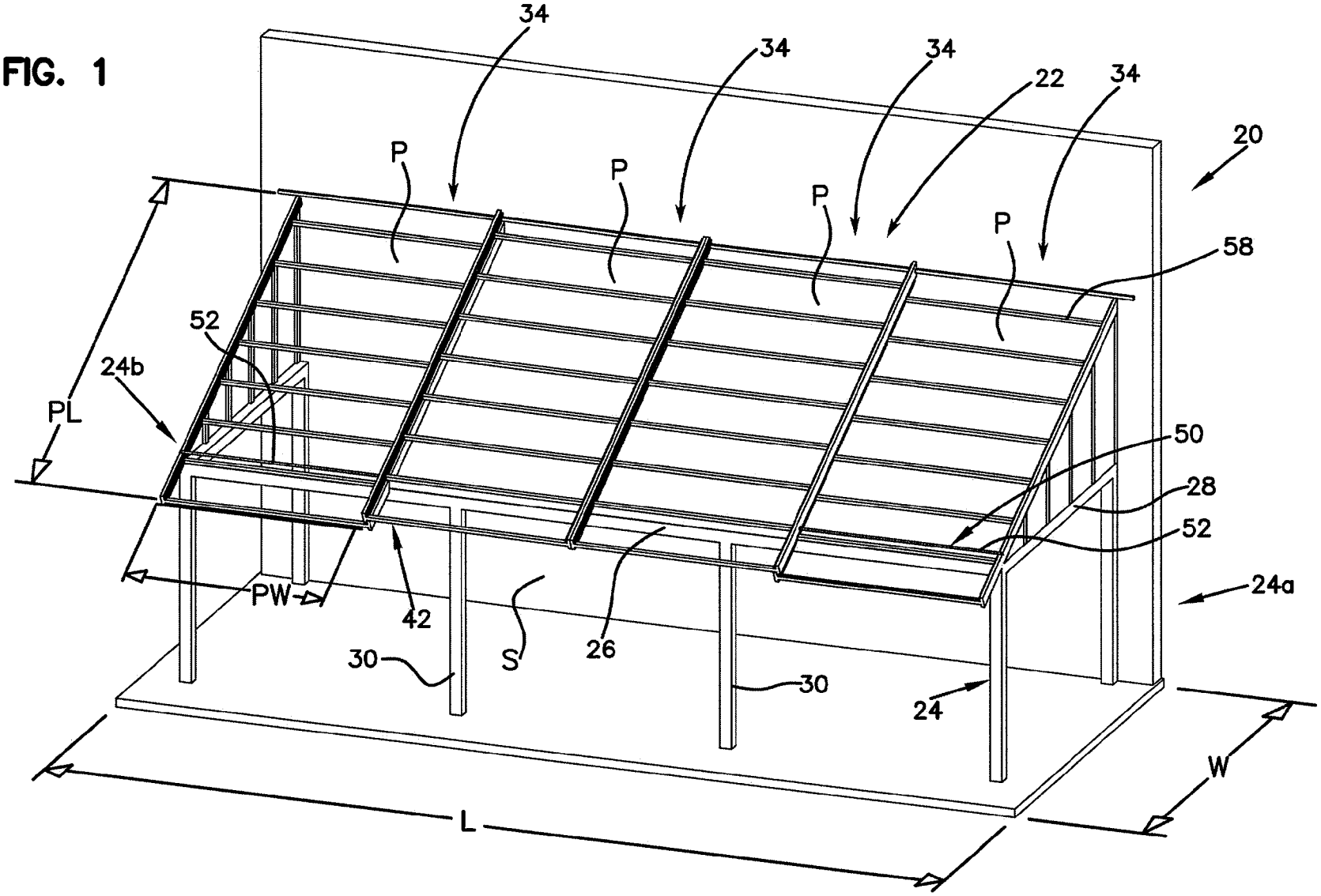
FIG. 1 is a perspective view of a building structure in accordance with the principles of the present disclosure, the building structure has a convertible roof shown in a closed configuration.
Figure 2:
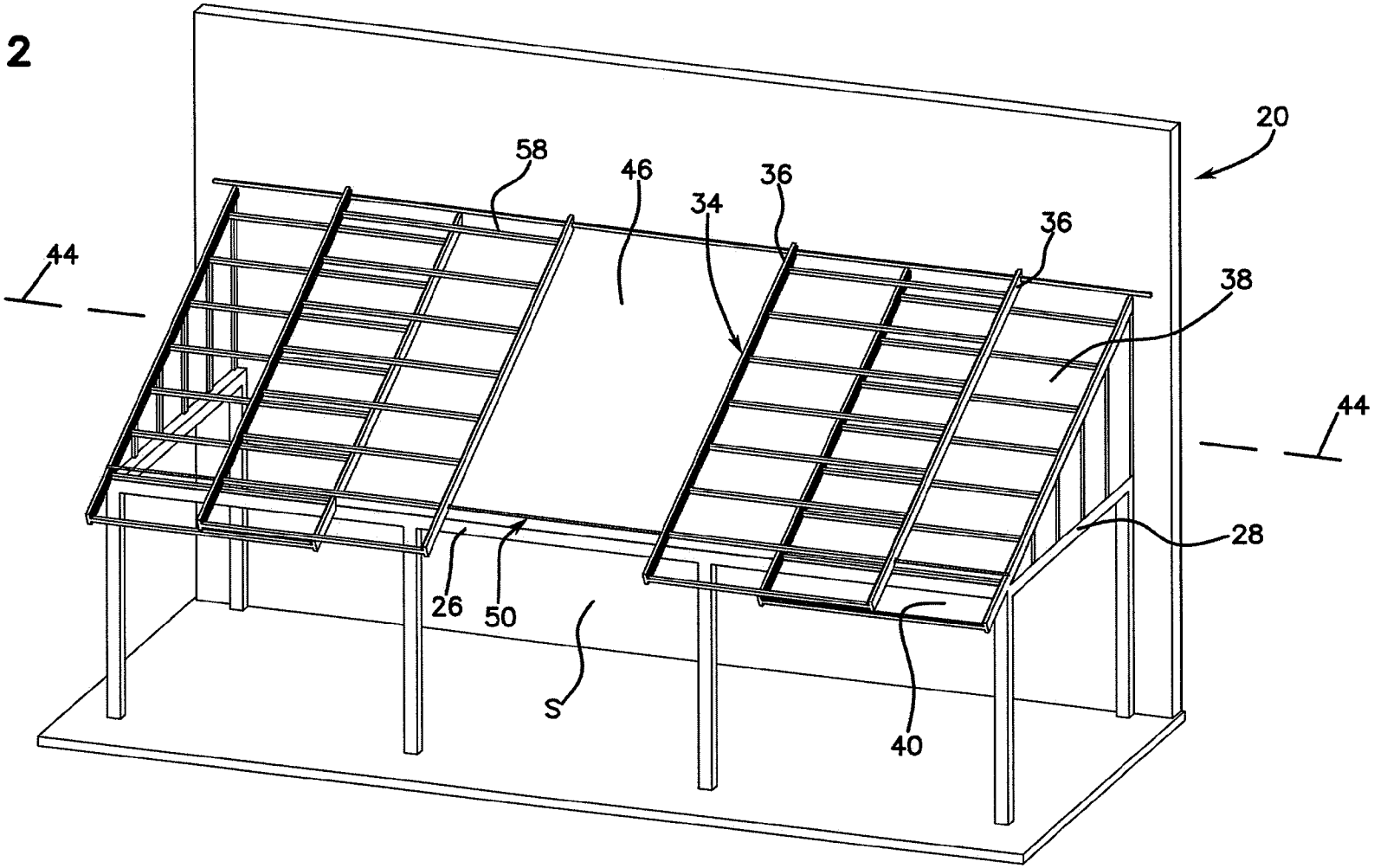
FIG. 2 is a perspective view showing the building structure of FIG. 1 with the convertible roof in a partially open configuration.
Figure 3:
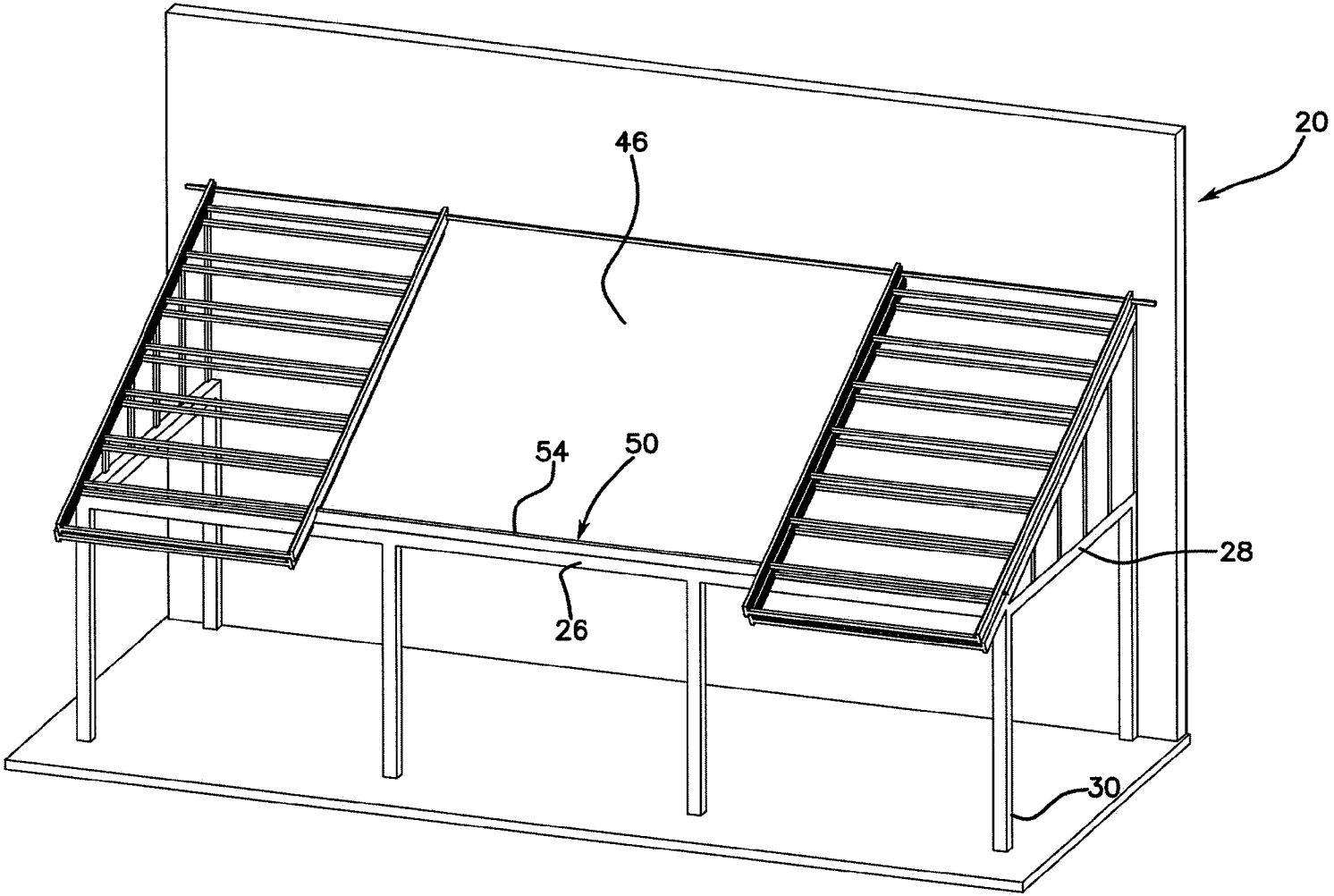
FIG. 3 is a perspective view of the building structure of FIG. 1 with the convertible roof in a fully opened configuration.

FIGS. 1-10 illustrate a building structure 20 in accordance with the principles of the present disclosure. The building structure 20 has a roof 22 that is convertible between closed configuration (see FIG. 1) and an open configuration (see FIG. 3). FIG. 2 shows the roof 22 in an intermediate configuration between the closed and open configurations.

Referring to FIG. 1, the building structure 20 includes a primary frame structure 24 that defines a structure length L and a structure width W. The primary frame structure 24 includes a longitudinal header 26 that extends along the structure length L and cross-headers 28 that extend along the structure width W. The cross-headers are positioned at opposite first and second ends 24*a*, 24*b* of the primary frame structure 24. The longitudinal header 26 is connected to the cross-headers 28 at the first and second ends 24*a*, 24*b* of the primary frame structure 24. The primary frame structure 24 further includes columns 30 that support the longitudinal header 26 and the cross-headers 28 at an elevated position above the ground.

Referring still to FIG. 1, the roof 22 of the building structure 20 includes a plurality of roof sections 32 (i.e., roof segments) mounted on the primary frame structure 24. The roof sections 24 each include a roof panel P having a panel length PL that extends along the structure width W and a panel width PW that extends along the structure length L. The roof sections 32 include panel frames 34 that support the panels P. Panel frames 34 include primary frame members 36 (e.g., rafters) that support longitudinal edges of the panels P. The primary frame members 36 extend along the panel lengths PL and are positioned on opposite sides of the panel widths PW. The roof sections 32 include main portion 38 that cover an interior space S defined by the primary frame structure 24. The roof sections 32 also include overhang portions 40 that project outwardly past the longitudinal header 26. The overhang portions 40 cooperate to form a continuous overhang 42 when the roof is in closed configuration. The continuous overhang 42 projects outwardly from the longitudinal header 26 and has an overhang length that extends along the structure length L.

The plurality of roof sections 32 includes first and second stationary roof sections 32*si*, 32*s*2 mounted to the primary frame structure 24 adjacent the first and second ends 24*a*, 24*b* of the primary frame structure 24. The plurality of roof sections 32 also includes first and second moveable roof sections $\mathbf{32}_{M1}$, $\mathbf{32}_{M2}$ slidably mounted relative to the primary frame structure 24 along a slide axis 44 that extends along the structure length L. The stationary roof sections $\mathbf{32}_{S1}$, $\mathbf{32}_{S2}$ are fixed relative to the primary frame structure 24, while the moveable roof sections $\mathbf{32}_{M1}$, $\mathbf{32}_{M2}$ are slidably moveable relative to the primary frame structure 24 and the stationary roof sections $\mathbf{32}_{S1}$, $\mathbf{32}_{S2}$. The first and second moveable roof sections $\mathbf{32}_{M1}$, $\mathbf{32}_{M2}$ cover a central portion 46 of the interior space S of the building structure 20 when the roof 22 is in the closed configuration of FIG. 1. When the roof is in the closed configuration, the first and second moveable roof sections $\mathbf{32}_{M1}$, $\mathbf{32}_{M2}$ only slightly overlap their respective first and second stationary roof sections $\mathbf{32}_{S1}$, $\mathbf{32}_{S2}$. In contrast, when the roof 22 is in the open configuration of FIG. 3, the moveable roof sections $\mathbf{32}_{M1}$, $\mathbf{32}_{M2}$ overlap majorities of their respective first and second stationary roof sections $\mathbf{32}_{S1}$, $\mathbf{32}_{S2}$. In this way, when the roof is in the open configuration of FIG. 3, the central portion 46 of the interior space S is uncovered.

Figure 6:
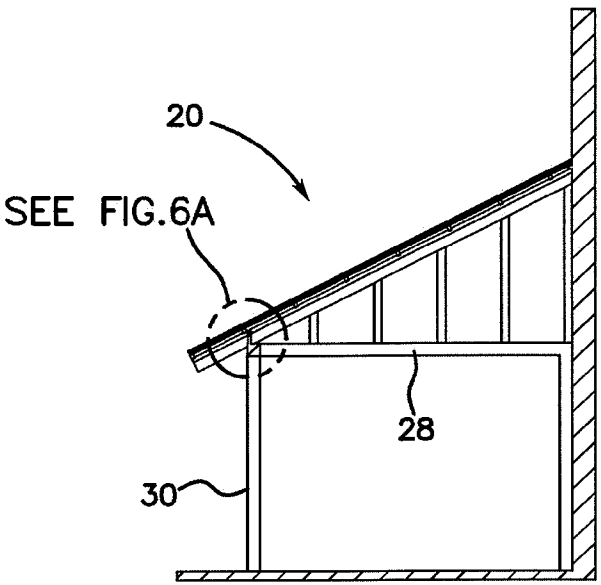
FIG. 6 is a cross-sectional view taken along section line 6-6 of FIG. 5.
Figure 6A:
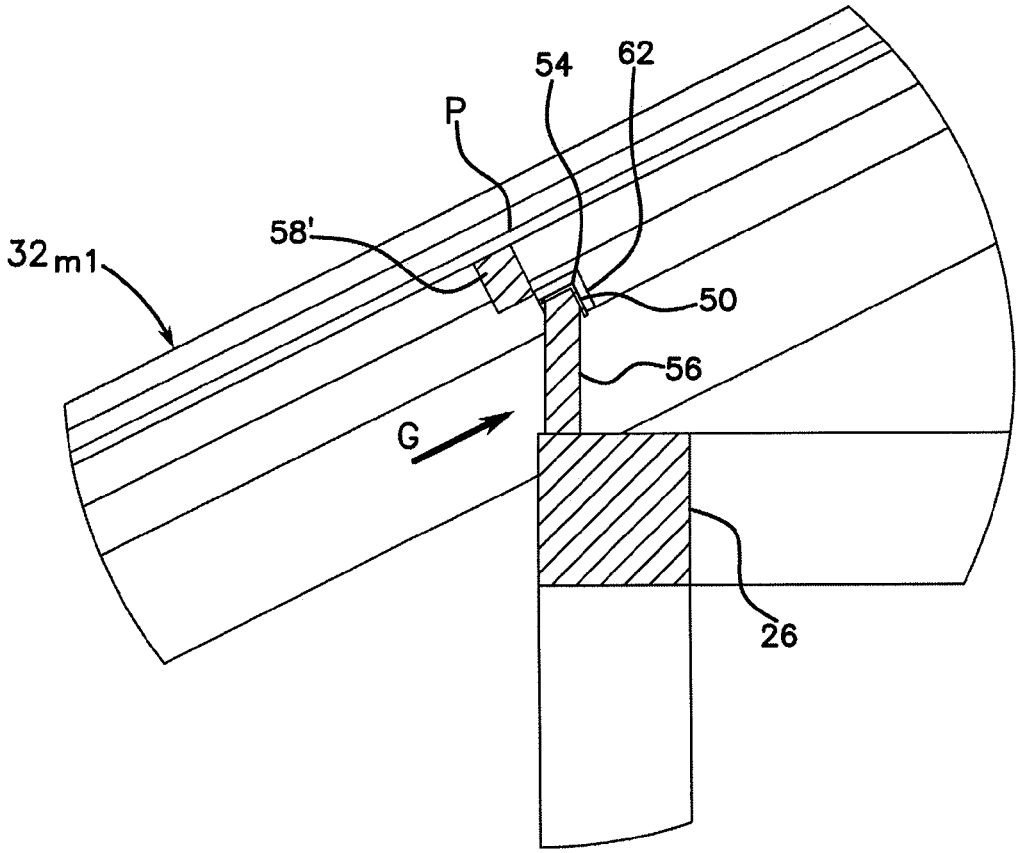
FIG. 6A is a detailed view of a portion of FIG. 6.
Figure 7:
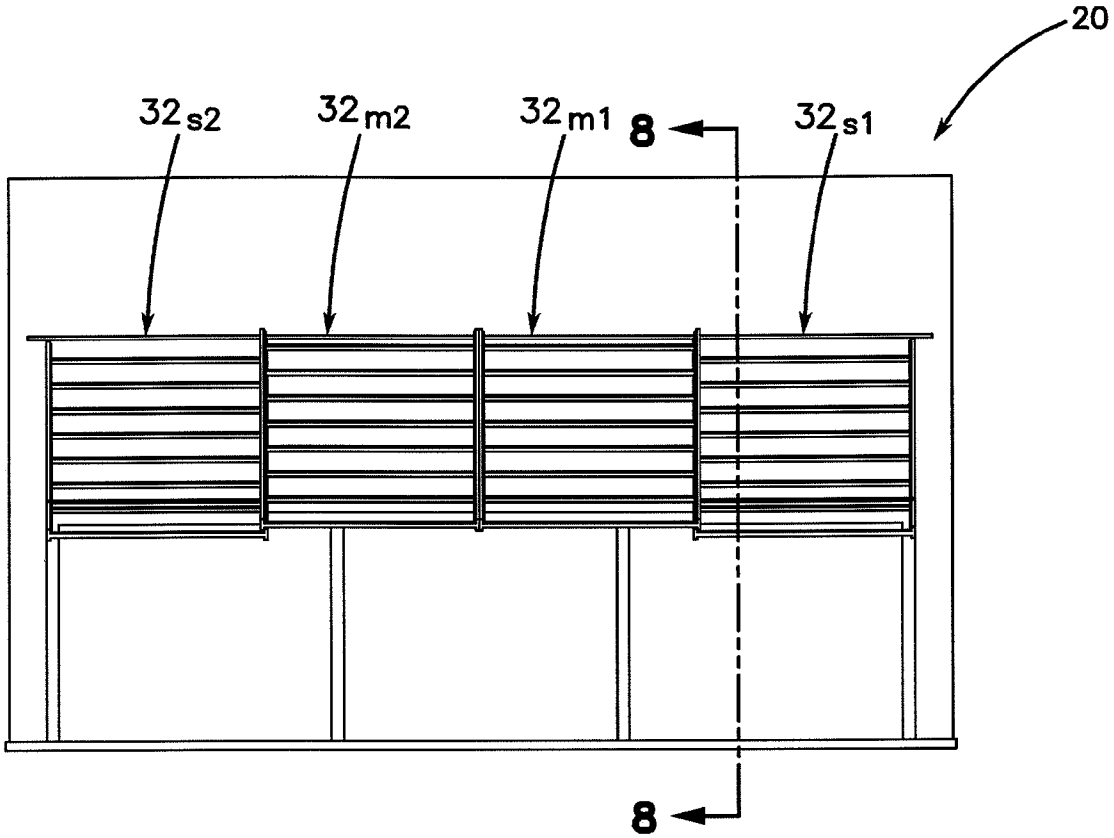
FIG. 7 is a front view of the building structure of FIG. 1.

The building structure 20 further includes a track 50 (see FIGS. 1, 3, 4, 4A, 6A and 8A) that supports the first and second moveable roof sections $\mathbf{32}_{M1}$, $\mathbf{32}_{M2}$. The track 50 extends along the longitudinal header 26 between the first and second ends 24*a*, 24*b* of the primary frame structure 24. The track includes first portions 52 (see FIG. 1) that extend across the first and second stationary roof sections $\mathbf{32}_{S1}$, $\mathbf{32}_{S2}$ at locations above the panels P of the first and second stationary roof sections $\mathbf{32}_{S1}$, $\mathbf{32}_{S2}$. The first and second moveable roof sections $\mathbf{32}_{M1}$, $\mathbf{32}_{M2}$ ride on the first portions 52 of the track 50 when the roof 22 is moved between the open and closed configurations. The track 50 also includes a second portion 54 that extends along the longitudinal header 26 between the first portions 52 of the track 50. The second portion 54 of the track (shown at FIGS. 2 and 3) coincides with the central portion 46 of the interior space S of the building structure 20. As shown at FIG. 6A, the second portion 54 of the track 50 is supported on a filler 56 that elevates the track 50 relative to the longitudinal header 26 and that assists in filling a gap G between a top side of the longitudinal header 26 and bottom sides of the panels P of the moveable roof sections $\mathbf{32}_{M1}$, $\mathbf{32}_{M2}$. The filler 56 has a height that generally equals a distance from a top side of the longitudinal header 26 to top sides of the panels P of the stationary roof sections $\mathbf{32}_{S1}$, $\mathbf{32}_{S2}$.

The panel frames 34 of the roof sections 32 can include cross members 58 that are attached to the primary frame members 36 of the roof sections 32 and that extend across the panel widths PW at locations below the panels P. The moveable roof sections $\mathbf{32}_{M1}$, $\mathbf{32}_{M2}$ include first cross members 58' (see FIG. 6A) that are positioned adjacent to the filler 56 and cooperate with the filler 56 to fill the gap G between the top side of the longitudinal header 26 and the bottom sides of the panels P of the moveable roof sections $\mathbf{32}_{M1}$, $\mathbf{32}_{M2}$.

Figure 4:
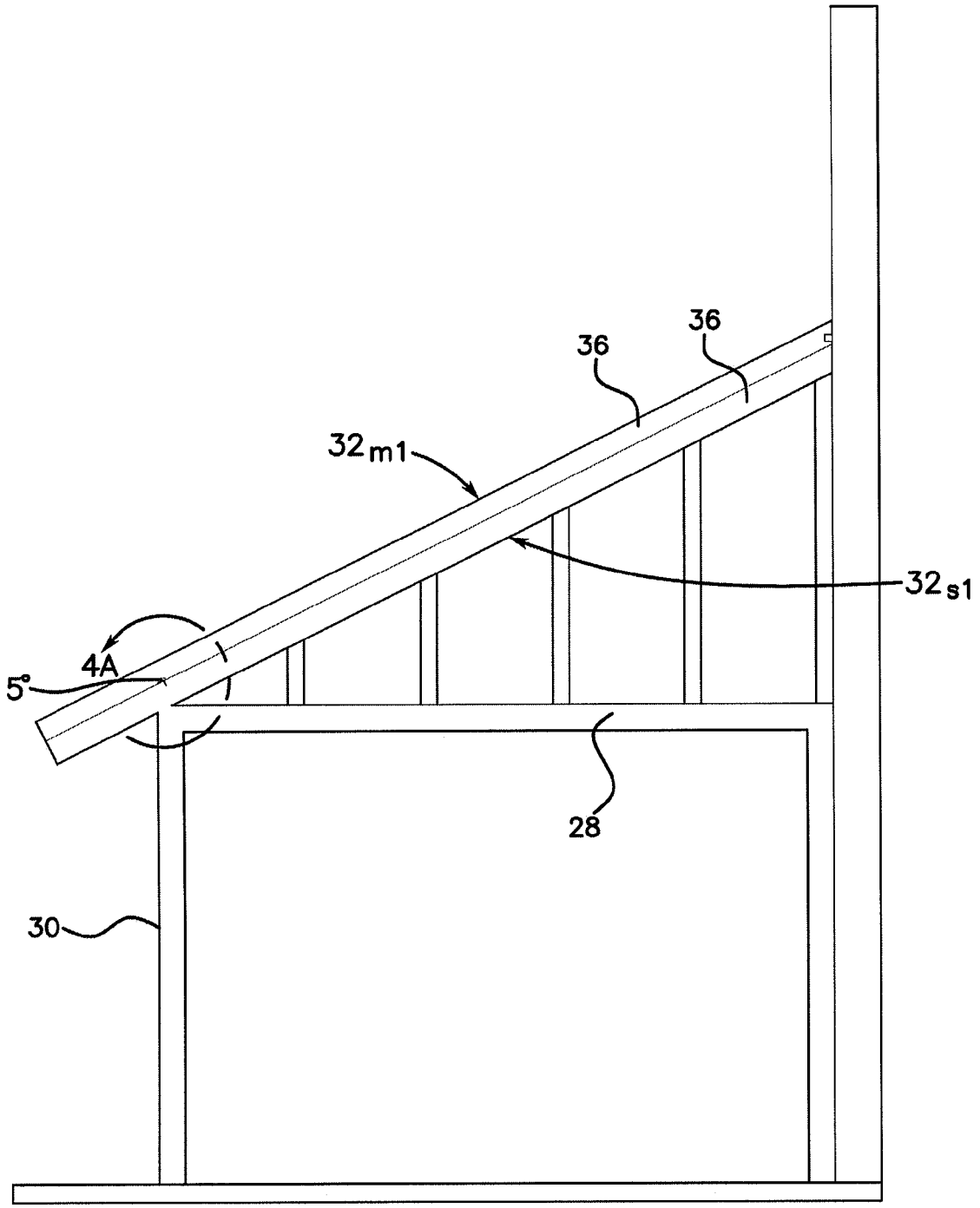
FIG. 4 is an end view of the building structure of FIG. 1.
Figure 4A:
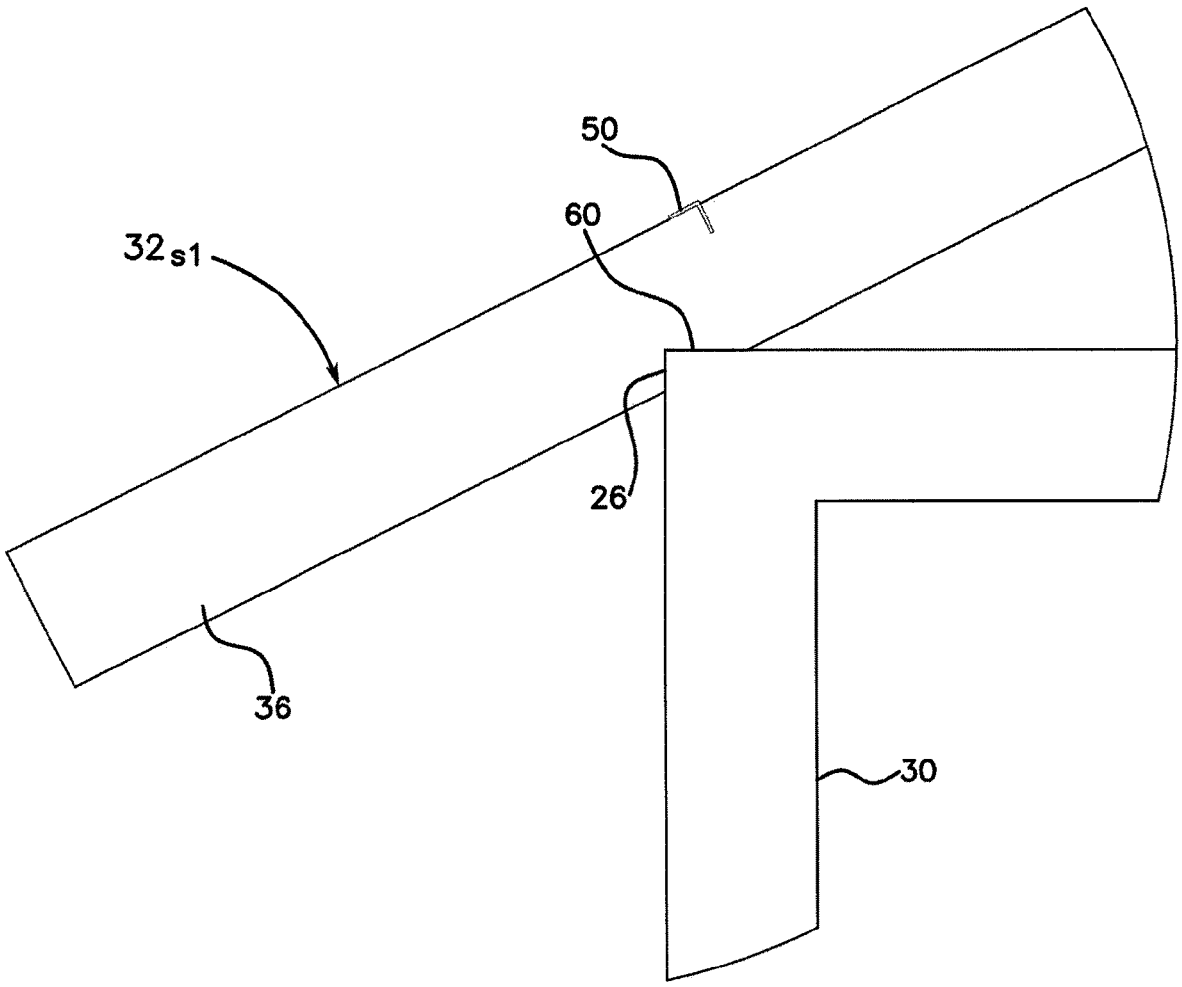
FIG. 4A is a detailed view of a portion of FIG. 4.
Figure 5:
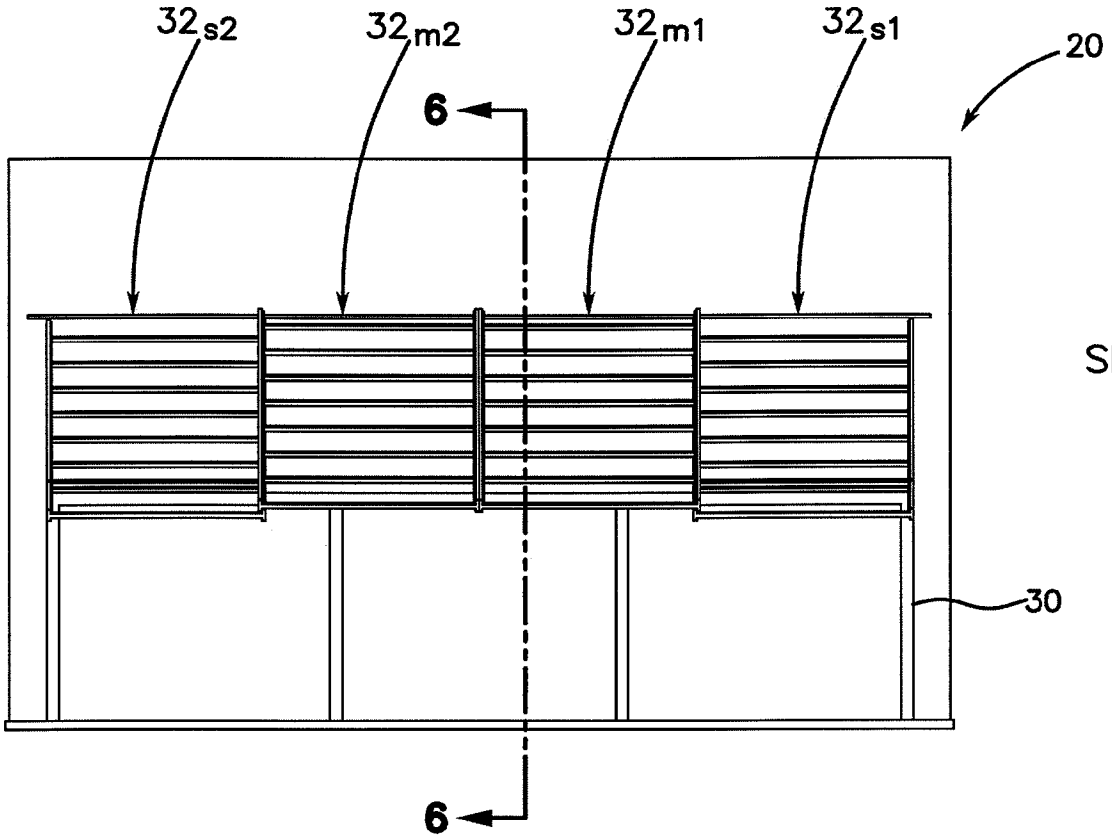
FIG. 5 is a front view of the building structure of FIG. 1.

Referring to FIG. 4A, the primary frame members 36 of the panel frames 34 of the stationary roof sections $\mathbf{32}_{S1}$, $\mathbf{32}_{S2}$ include notches 60 that receive portions of the longitudinal header 26 such that bottom sides of the panels P of the stationary roof sections $\mathbf{32}_{S1}$, $\mathbf{32}_{S2}$ are lower relative to the top side of the longitudinal header 26. First cross members 58" (see FIG. 8A) of the stationary roof sections $\mathbf{32}_{S1}$, $\mathbf{32}_{S2}$ are positioned adjacent to the top side of the longitudinal header 26 to fill the gap G between the top side of the longitudinal header 26 and the bottom sides of the panels P of the stationary roof sections $\mathbf{32}_{S1}$, $\mathbf{32}_{S2}$.

Figure 8:
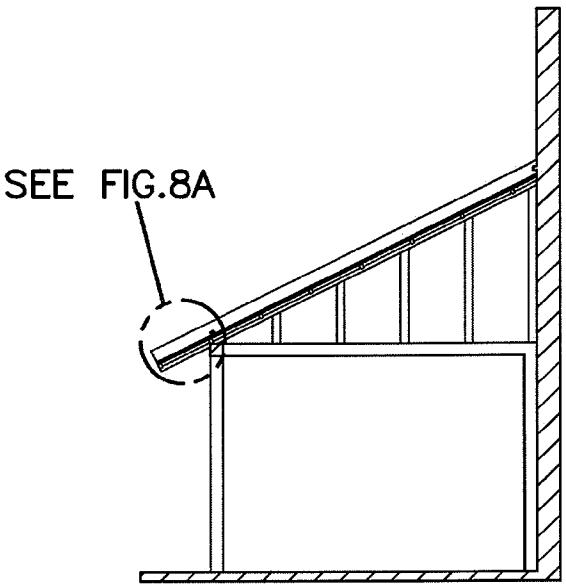
FIG. 8 is a cross-sectional view taken along section line 8-8 of FIG. 7.
Figure 8A:
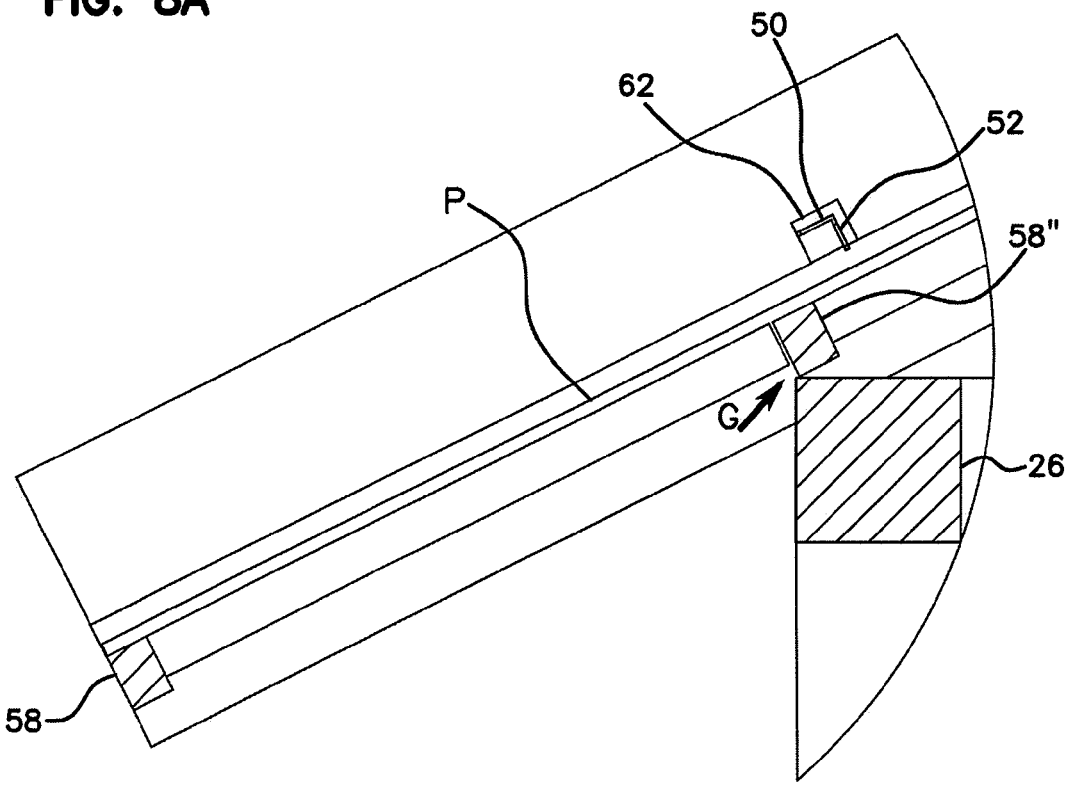
FIG. 8A is a detailed view of a portion of FIG. 8.
Figure 9:
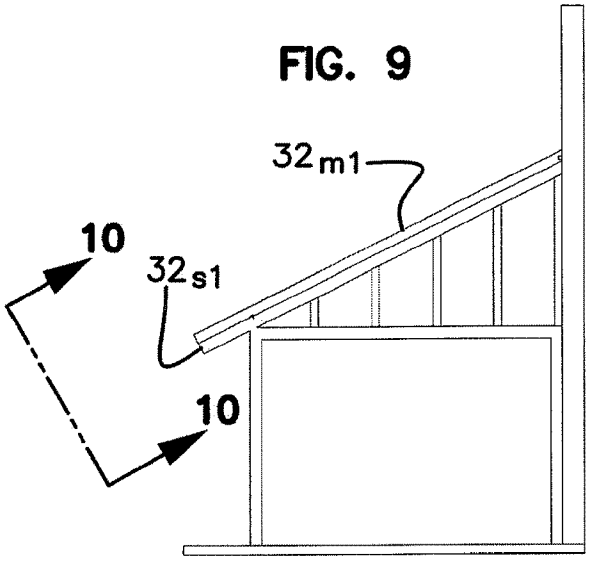
FIG. 9 is an end view of the building structure of FIG. 1.
Figure 10:
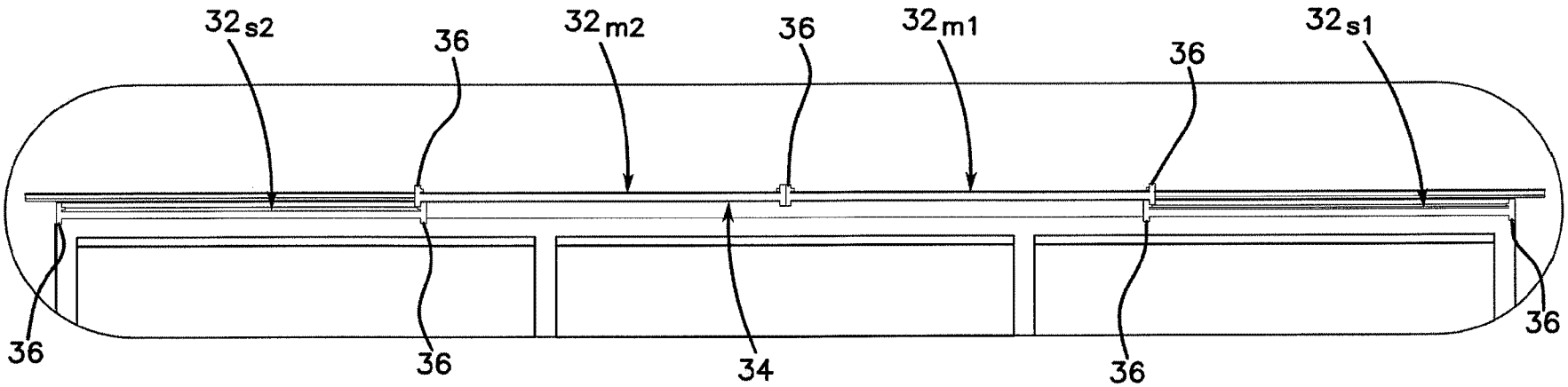
FIG. 10 is a view taken along view line 10-10 of FIG. 9.

Referring to FIGS. 6A and 8A, the primary frame members 36 of the panel frames 34 of the moveable roof sections $\mathbf{32}_{M1}$, $\mathbf{32}_{M2}$ define lower notches 62 that receive the track 50 to allow the moveable roof sections $\mathbf{32}_{M1}$, $\mathbf{32}_{M2}$ to slide along and be guided by the track 50. Low friction members 64 (e.g., Teflon) can be mounted within the lower notches 62 to facilitate sliding the moveable roof sections $\mathbf{32}_{M1}$, $\mathbf{32}_{M2}$ along the track 50.

The first portions 52 of the track 50 are attached to the primary frame members 36 of the panel frames 34 of the stationary roof sections $\mathbf{32}_{S1}$, $\mathbf{32}_{S2}$. In this way, the first portions 52 bridge a distance across the panel width PW of the stationary roof sections $\mathbf{32}_{S1}$, $\mathbf{32}_{S2}$ between the primary frame members 36. Preferably, the first portions 52 of the track 50 are spaced from the top sides of the panels P of the first and second stationary roof sections $\mathbf{32}_{S1}$, $\mathbf{32}_{S2}$ such that water can flow between the top sides of the panels P and the first portions 52 of the track 50 from the main portions 38 of the stationary roof sections $\mathbf{32}_{S1}$, $\mathbf{32}_{S2}$ to the overhang portions 40 of the stationary roof sections $\mathbf{32}_{S1}$, $\mathbf{32}_{S2}$. Since the roof sections 32 are pitched upwardly as the roof sections 32 extend along the structure width W in a direction away from the overhang portions 40, this spacing is advantageous to allow water to freely flow onto the overhang portions 40 and then off of the building structure. The overhang portions 40 prevent water from draining onto the longitudinal header 26 and eliminate the need for gutters along the longitudinal header 26. As depicted, the overhang portions 40 of the roof sections 32 have a cantilevered configuration with unsupported free ends. In certain embodiments, the overhang portions 40 overhang the longitudinal header 26 by at least 6 inches, or at least 12 inches, or at least 18 inches.

In certain embodiments, the panels P have a continuous, seamless structure as the panels extend along the panel lengths PL. In certain embodiments, the panels P can be a polymeric material or a glass material. In certain embodiments, the panels P can be transparent, translucent, or opaque.

In other examples, the stationary roof sections $\mathbf{32}_{S1}$, $\mathbf{32}_{S2}$, can be moveably (e.g., slidably) mounted to the primary frame structure 24. In other examples, rollers can be used to facilitate moving the roof sections 32. In the depicted example, the roof sections 32 are arranged in a "lean-to" configuration. In other aspects of the present disclosure, roof sections as described herein can be used on primary frame structures having peaked configurations in which the roof sections are mounted on opposite sides of a peak defined by the primary frame structure.

Figure 11:
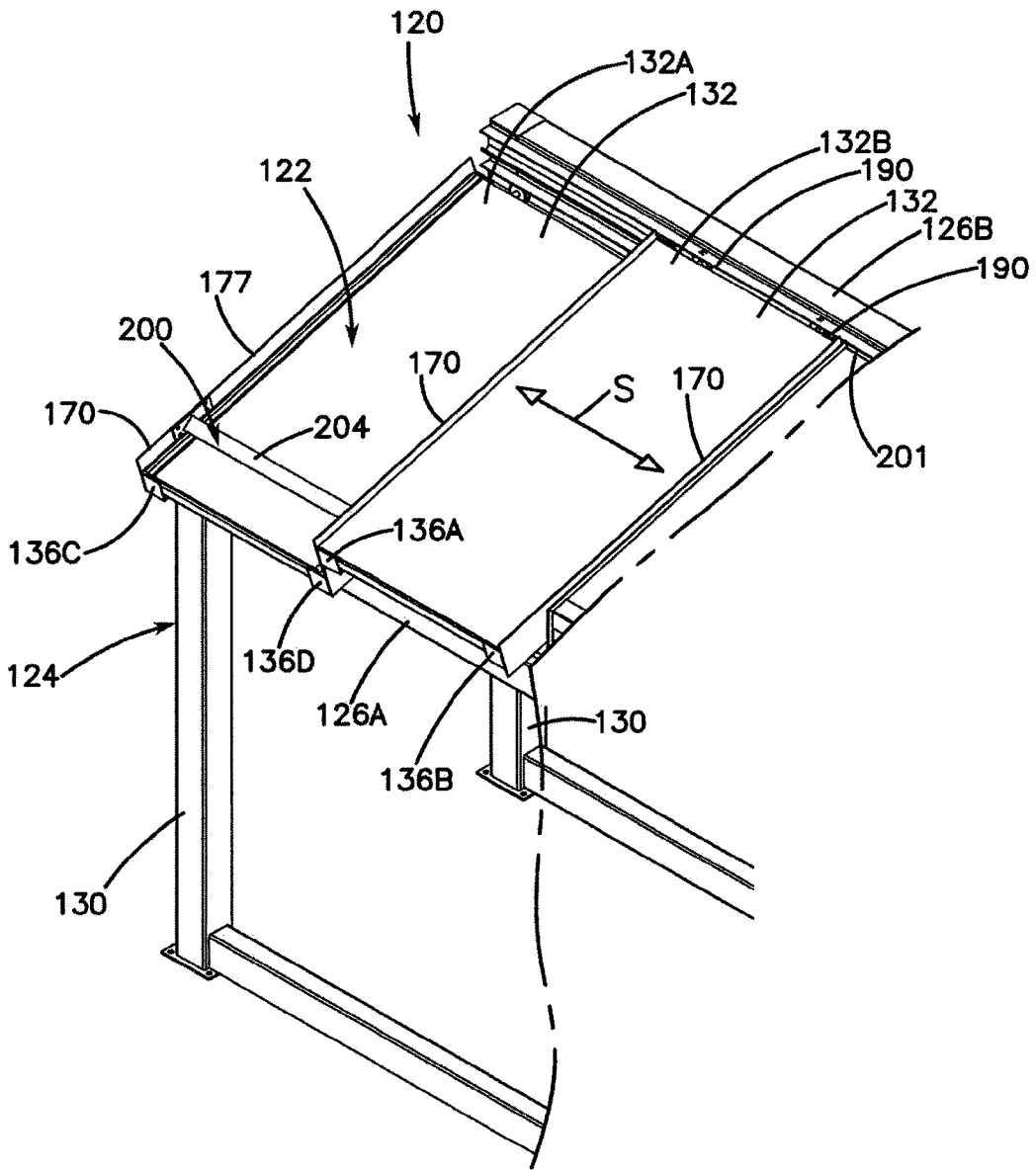
FIG. 11 is a perspective view of another building structure with a convertible roof in accordance with the principles of the present disclosure.
Figure 12:
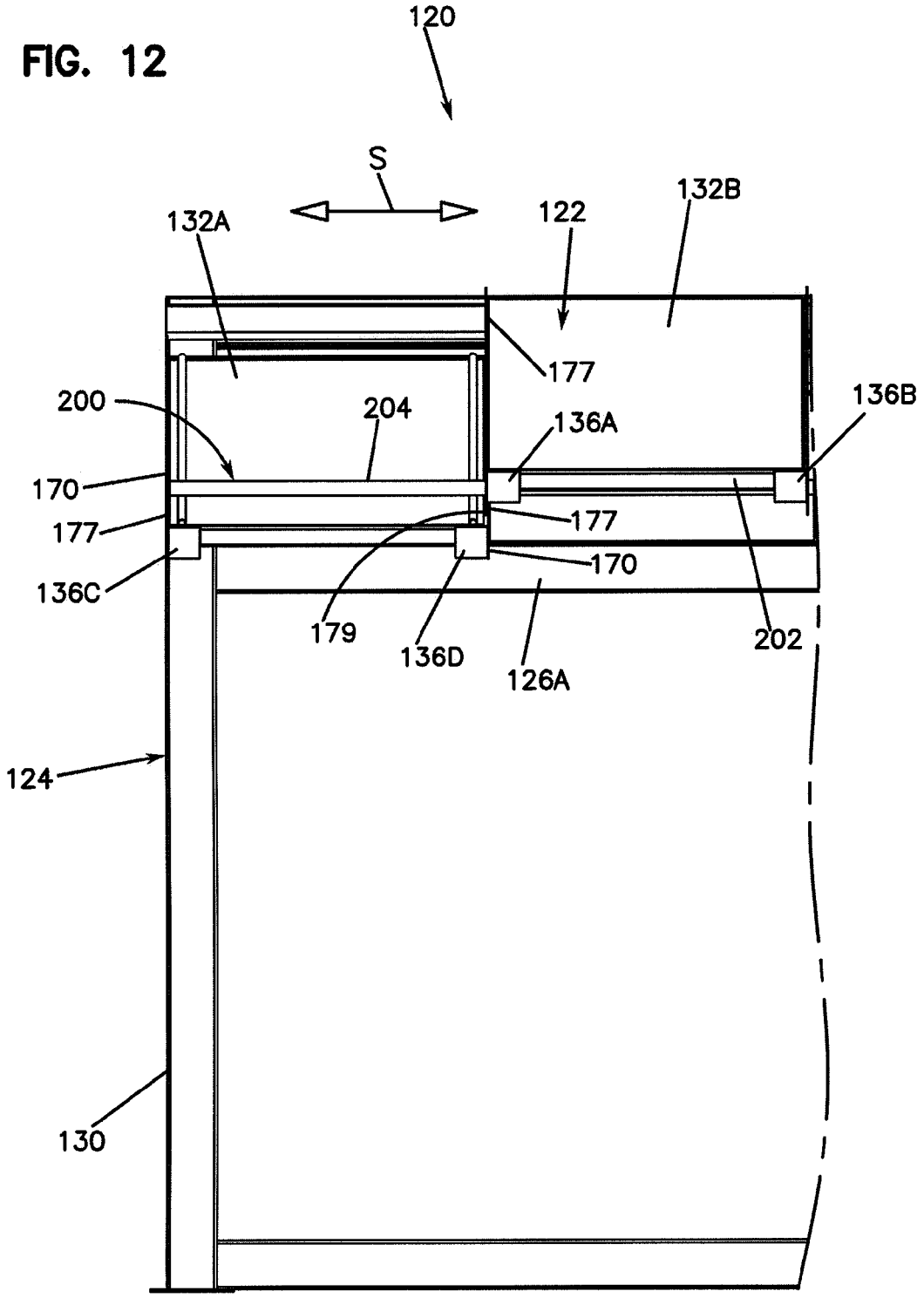
FIG. 12 is a front view of the building structure of FIG. 11.
Figure 13:
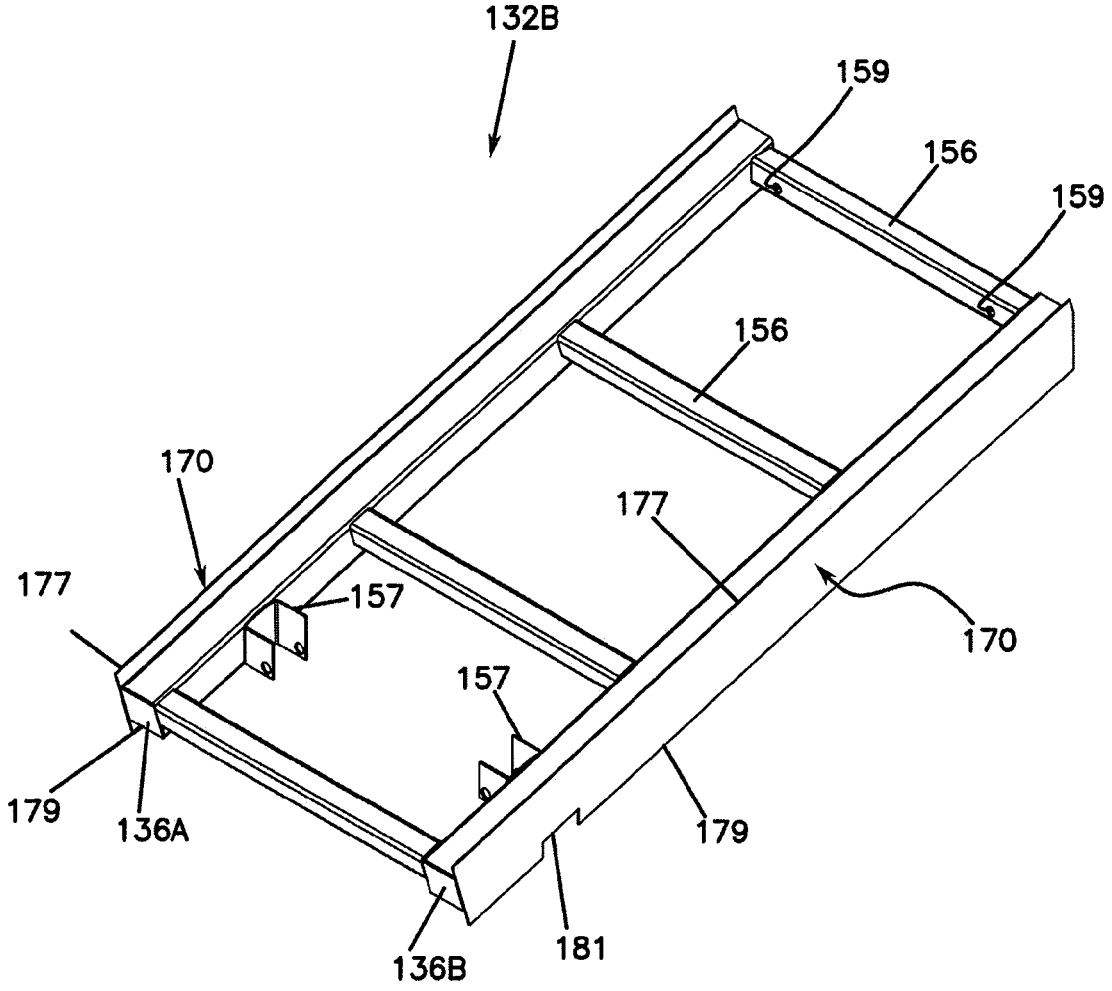
FIG. 13 is a perspective view of one of the roof sections of the convertible roof of FIGS. 11 and 12.

FIGS. 11 and 12 show a portion of another building structure 120 in accordance with the principles of the present disclosure. The building structure 120 has a roof 122 that is convertible between a closed configuration (see FIGS. 11 and 12) and an open configuration (see FIG. 33). At FIGS. 11 and 12, the roof 22 is shown including a plurality of roof sections 132. The roof sections 132 include a first roof section 132A and a second roof section 132B. In FIGS. 11 and 12, only half the roof 122 is depicted. It will be appreciated that the other half of the roof 122 can be configured in the mirror image of the depicted half of the roof 122.

Referring still to FIGS. 11 and 12, the building structure 120 includes a primary frame structure 124 having a first longitudinal header 126A and a second longitudinal header 126B. The second longitudinal header 126B is elevated relative to the first longitudinal header 126A such that the roof sections 132 are pitched toward the first longitudinal header 126A. The first and second longitudinal headers 126A, 126B can be supported above head level by a plurality of columns 130. The first and second longitudinal headers 126A, 126B can be parallel. In the depicted example, the second longitudinal header 126B is elevated relative to the first longitudinal header 126A. The building structure 120 can also include side sections forming side walls that enclose the interior space of the building structure 120.

Figure 24:
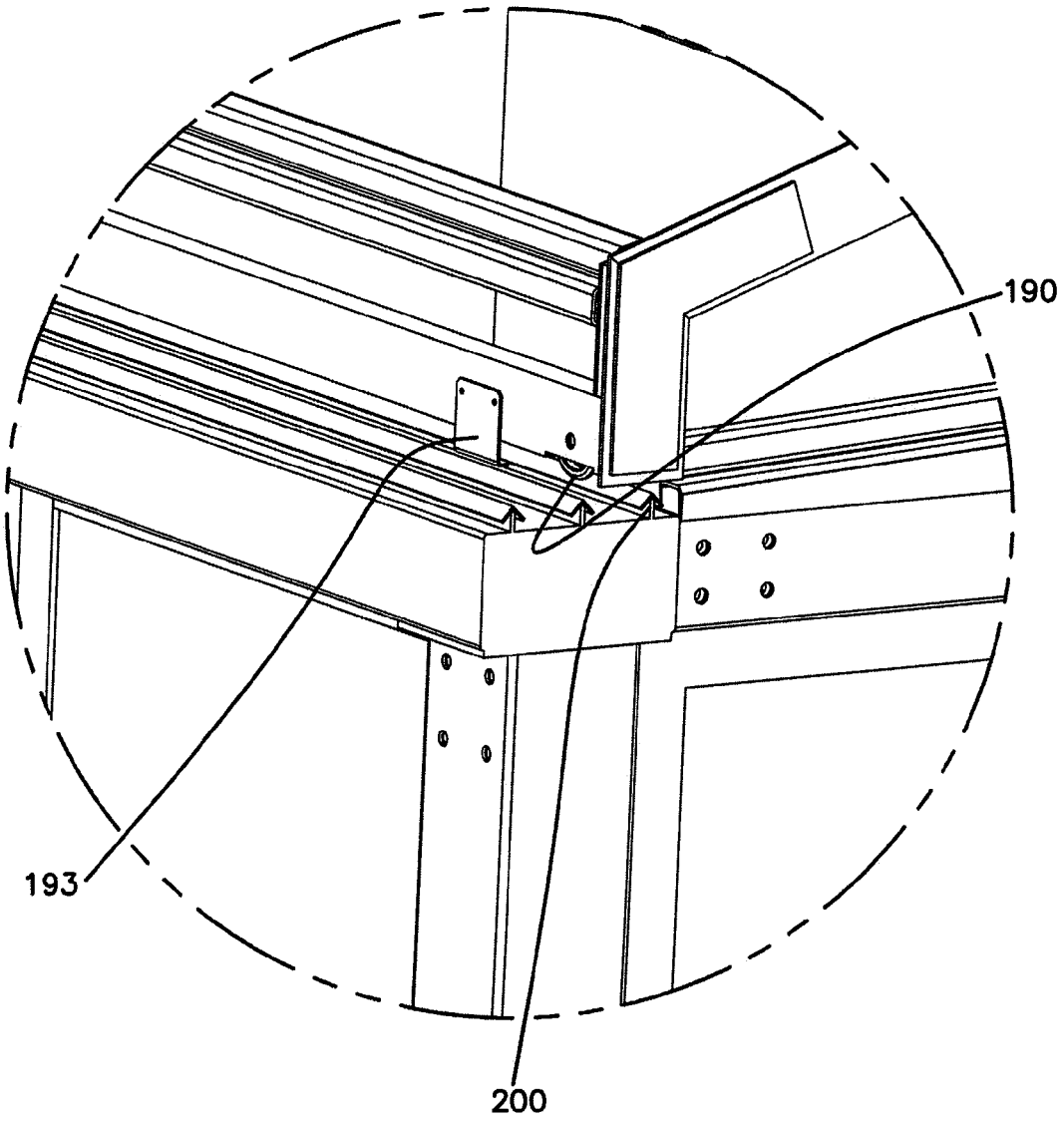
FIG. 24 is a perspective view showing a roller and hold-down bracket used suitable for slidably mounting a roof section to a track.
Figure 25:
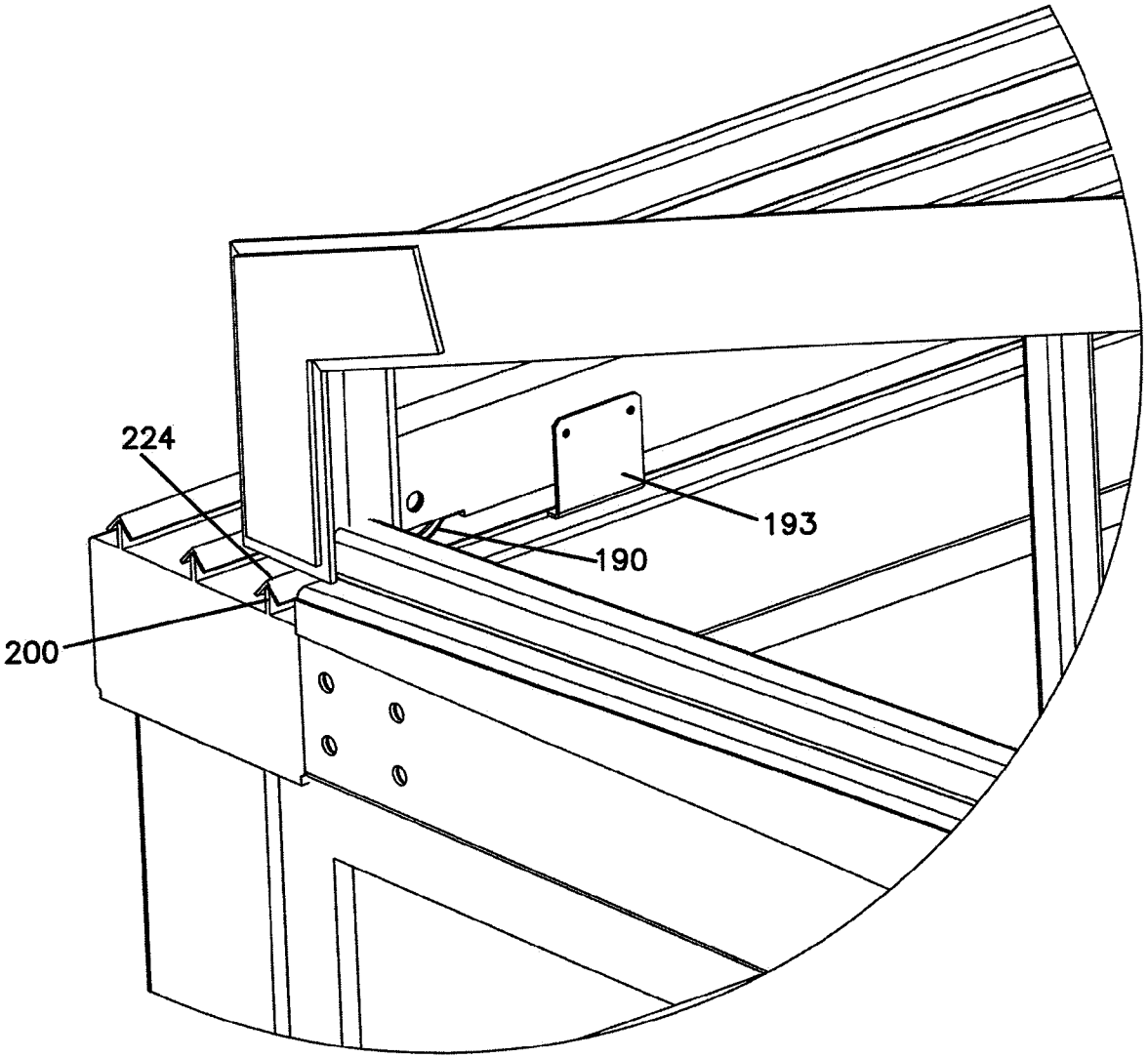
FIG. 25 is another perspective view of the arrangement of FIG. 25.
Figure 26:
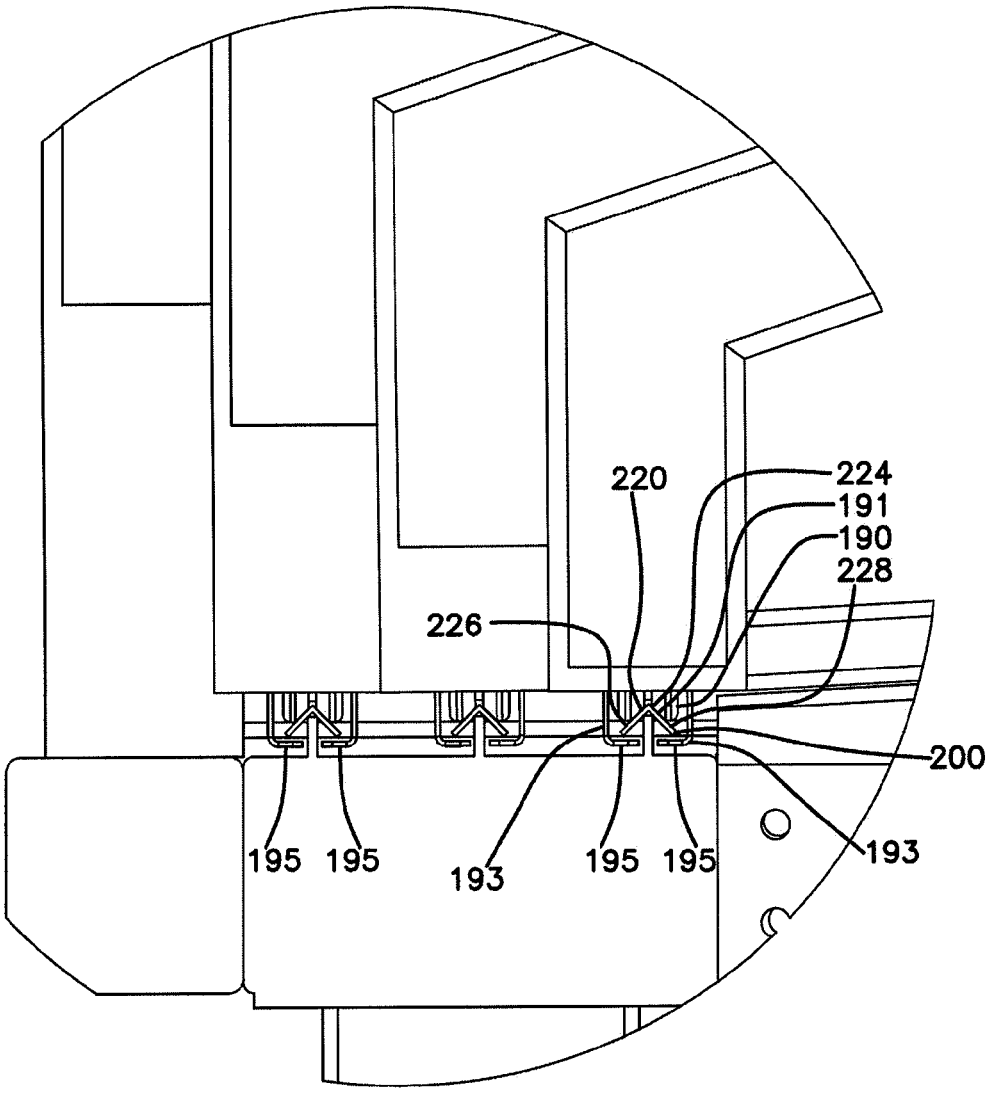
FIG. 26 is a cross-sectional view of the arrangement of FIG. 25.

In the depicted example, the first roof section 132A is fixed relative to the primary frame structure 124 and the second roof section 132B is moveable relative to the primary frame structure 124 and the first roof section 132A. For example, the second roof section 132B can be a slidably moved relative to the first roof section 132A between an open configuration (see FIGS. 11 and 12) and a closed configuration. When the convertible roof 122 is positioned in the open configuration, the second roof section 132B can be positioned over the first roof section 132A. The second roof section 132B is moveable relative to the first roof section 132A along a slide orientation S that is parallel to the lengths of the first and second headers 126A, 126B. In certain examples, rollers can be used to facilitate moving the second roof section 132B relative to the primary frame structure 124 and the first roof section 132A. An example roller 190 is shown at FIGS. 24-26. The rollers can ride along a first track 200 that extends along the slide orientation S and has a first portion 202 that is supported on the first longitudinal header 126A and a second portion 204 that extends over the first roof section 132A. An upper end of the second roof section 132B can be supported on a track 201 provided at the second longitudinal header 126B. In other examples, the first roof section 132A can be moveable relative to the primary frame structure 124.

Referring to FIGS. 13-16, the second roof section 132B includes first and second parallel rafters 136A, 136B interconnected by a plurality of cross members 156. One or more panels can be supported by the rafters 136A, 136B and the cross members 156. Brackets 157 can be provided for connecting rollers (e.g., rollers 190 as shown at FIGS. 24-26) to the rafters 136A, 136B. Rollers can also be mounted to an uppermost cross member 156 via pins or other fasteners that extend through openings 159 in the uppermost cross member 156.

The second roof section 132B includes stop structures such as stop plates 175. In certain examples, the stop plates 175 can be attached to the first and second rafters 136A, 136B. In certain examples, the stop plates 175 can be attached to outer surfaces of the first and second rafters 136A, 136B and can extend along the lengths of the first and second rafters 136A, 136B. In certain examples, the stop plates 175 can include upper portions 177 that project above the first and second rafters 136A, 136B and lower portions 179 that project below the first and second rafters 136A, 136B. In certain examples, the lower portions 179 can define track clearance notches 181 that align with the brackets 157 and provide clearance for the track 200. The brackets 157 can be mounted to inner surfaces of the first and second rafters 136A, 136B.

Figure 14:
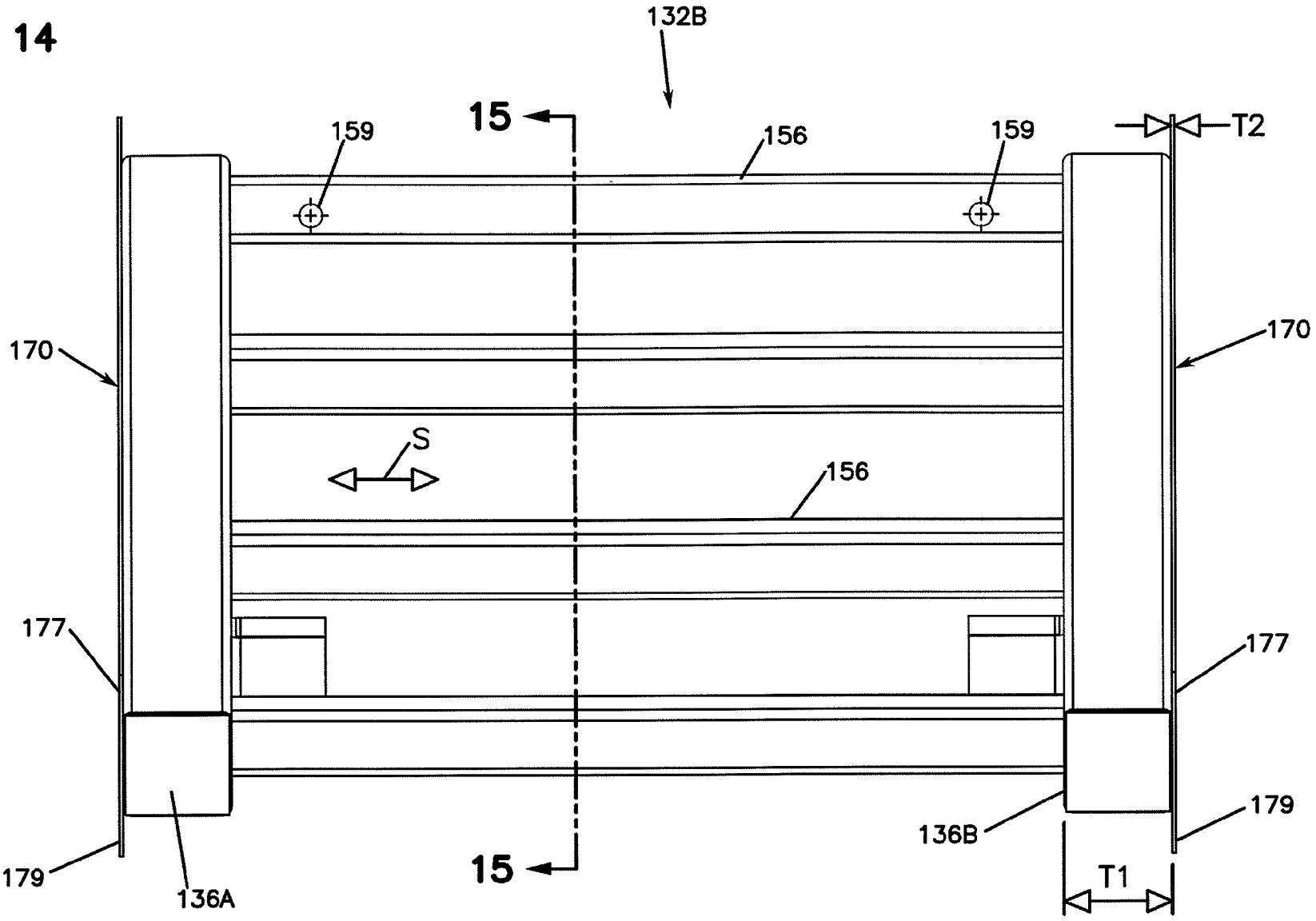
FIG. 14 is a front view of the roof section of FIG. 13.
Figure 15:
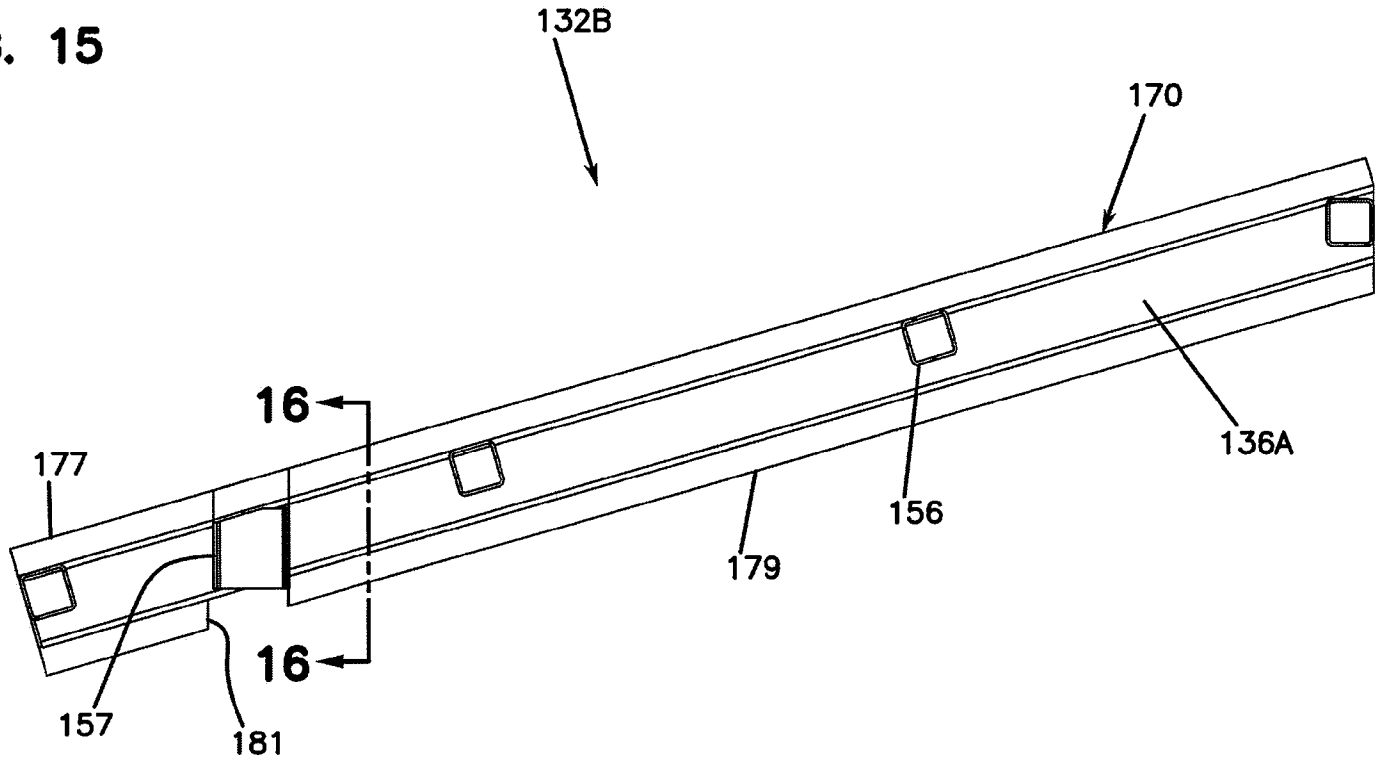
FIG. 15 is a cross-sectional view taken along section line 15-15 of FIG. 14.
Figure 16:
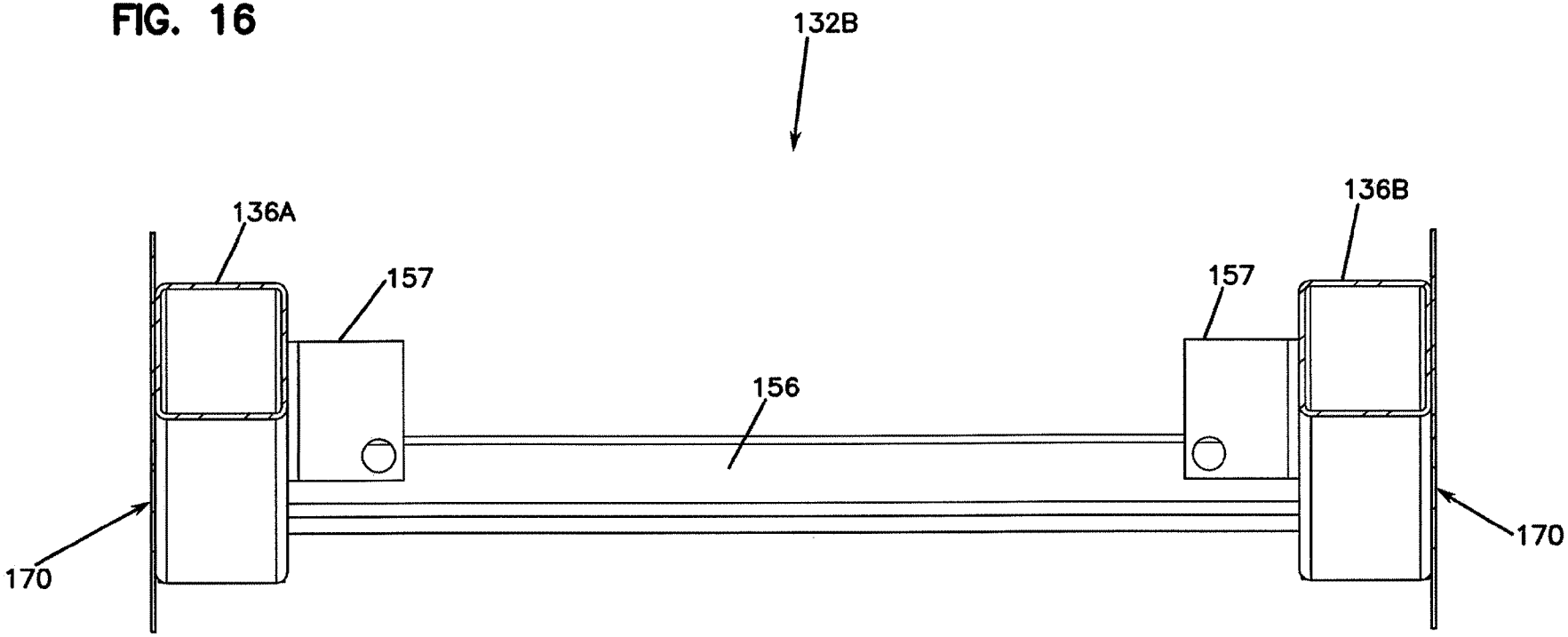
FIG. 16 is a cross-sectional view taken along section line 16-16 of FIG. 15.
Figure 17:
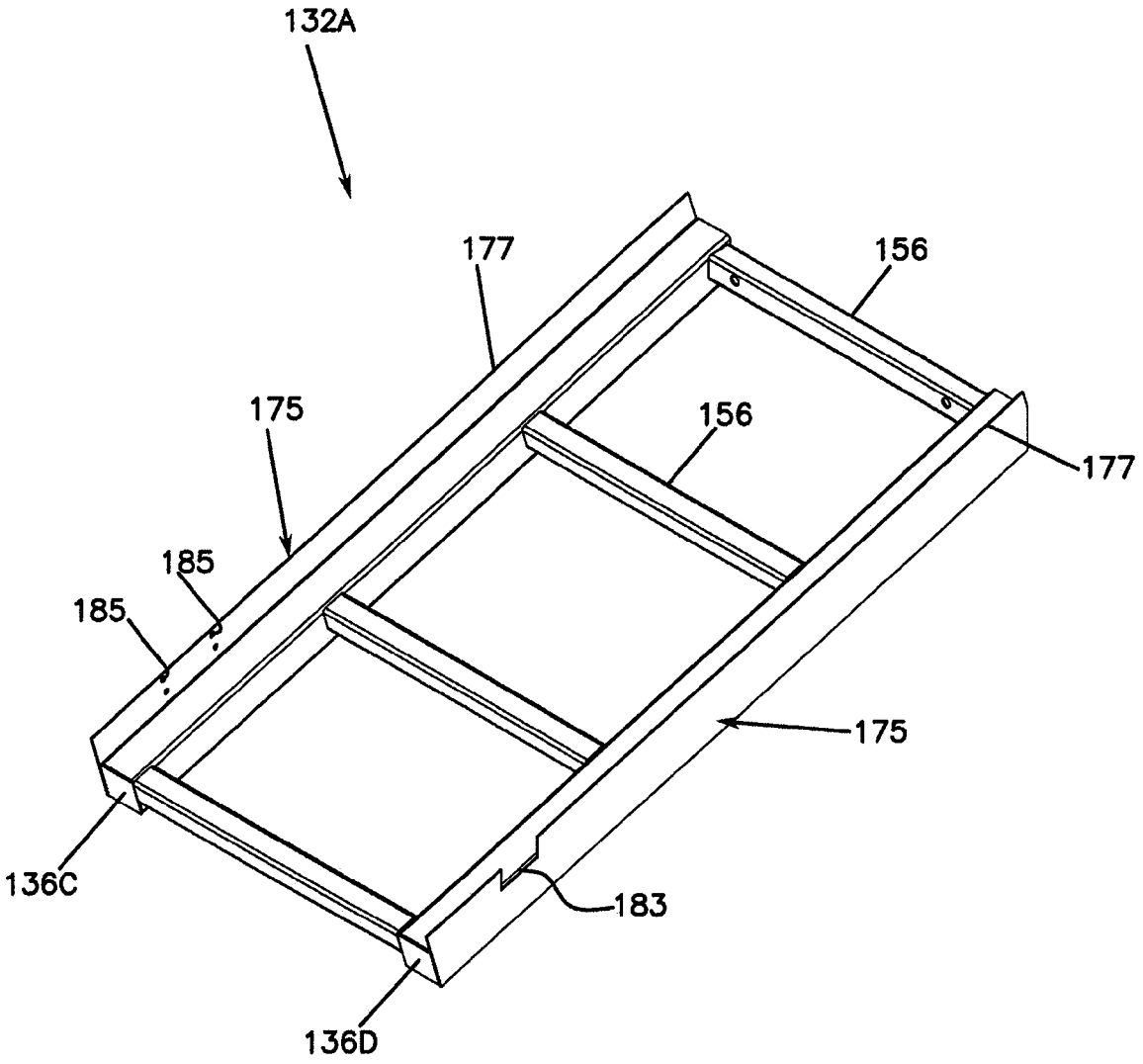
FIG. 17 is a perspective view of another roof section of the convertible roof of FIGS. 11 and 12.
Figure 18:
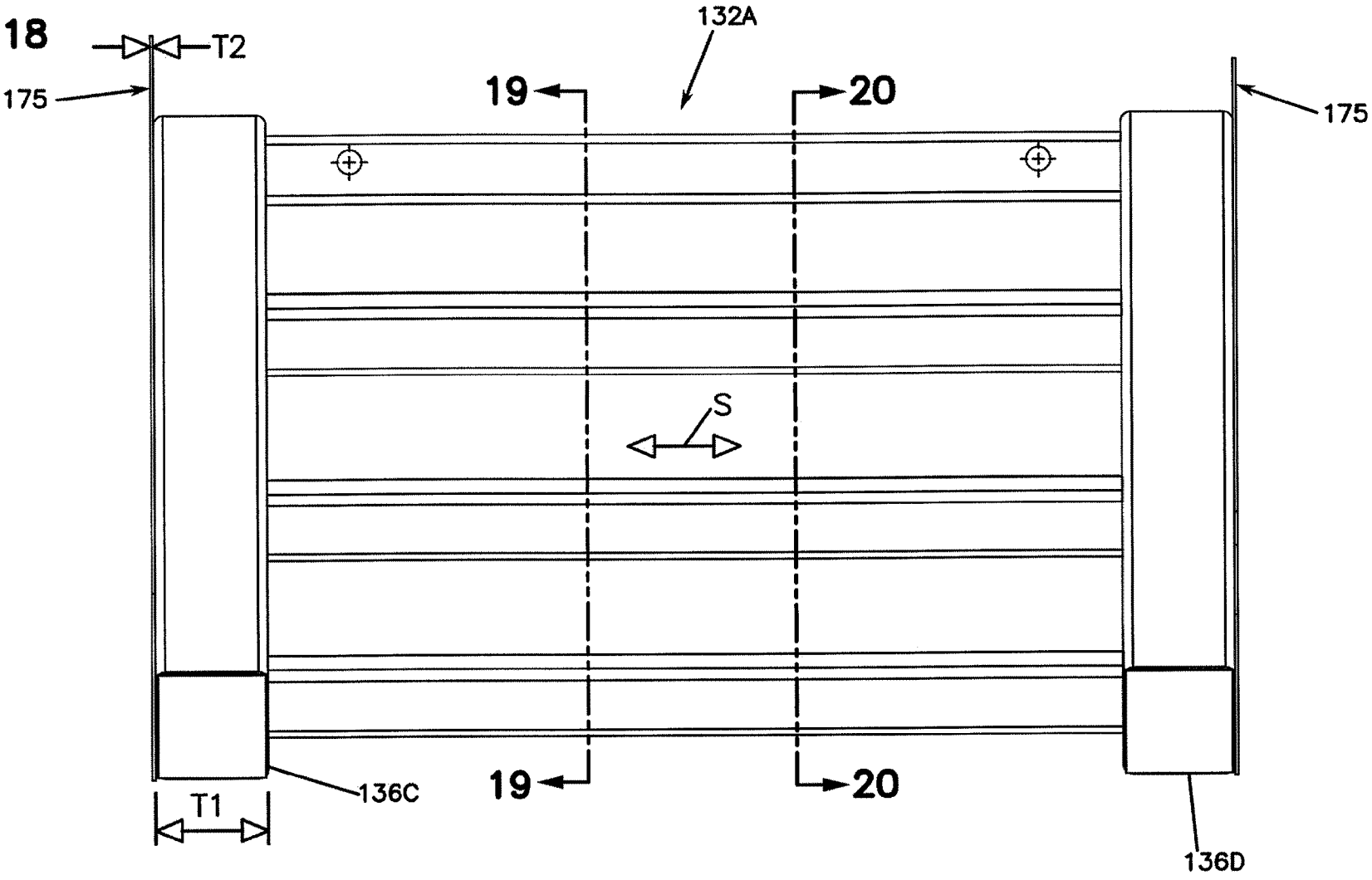
FIG. 18 is a front, perspective view of the roof section of FIG. 17.
Figure 19:
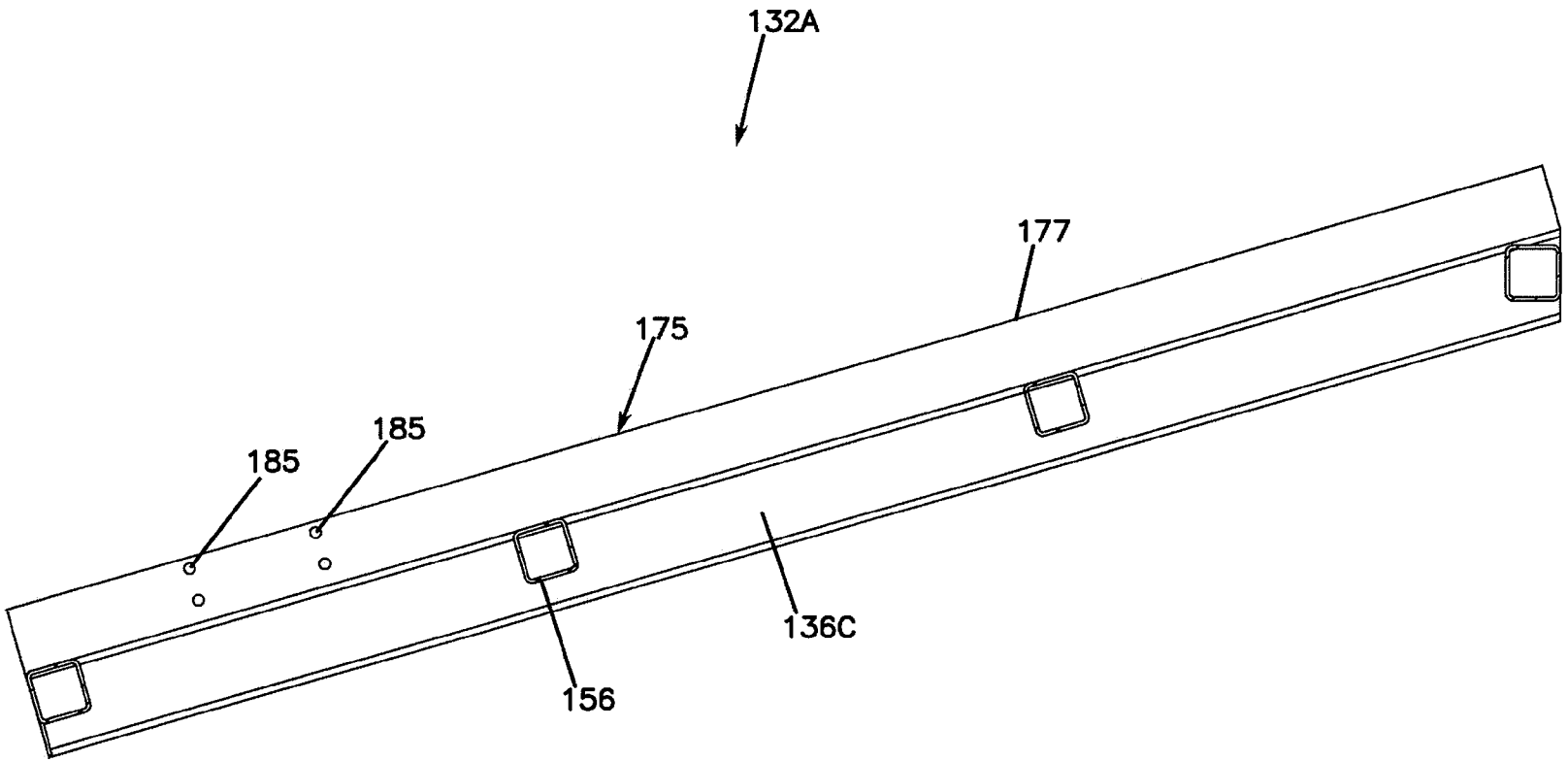
FIG. 19 is a cross-sectional view taken along section line 19-19 of FIG. 18.
Figure 20:
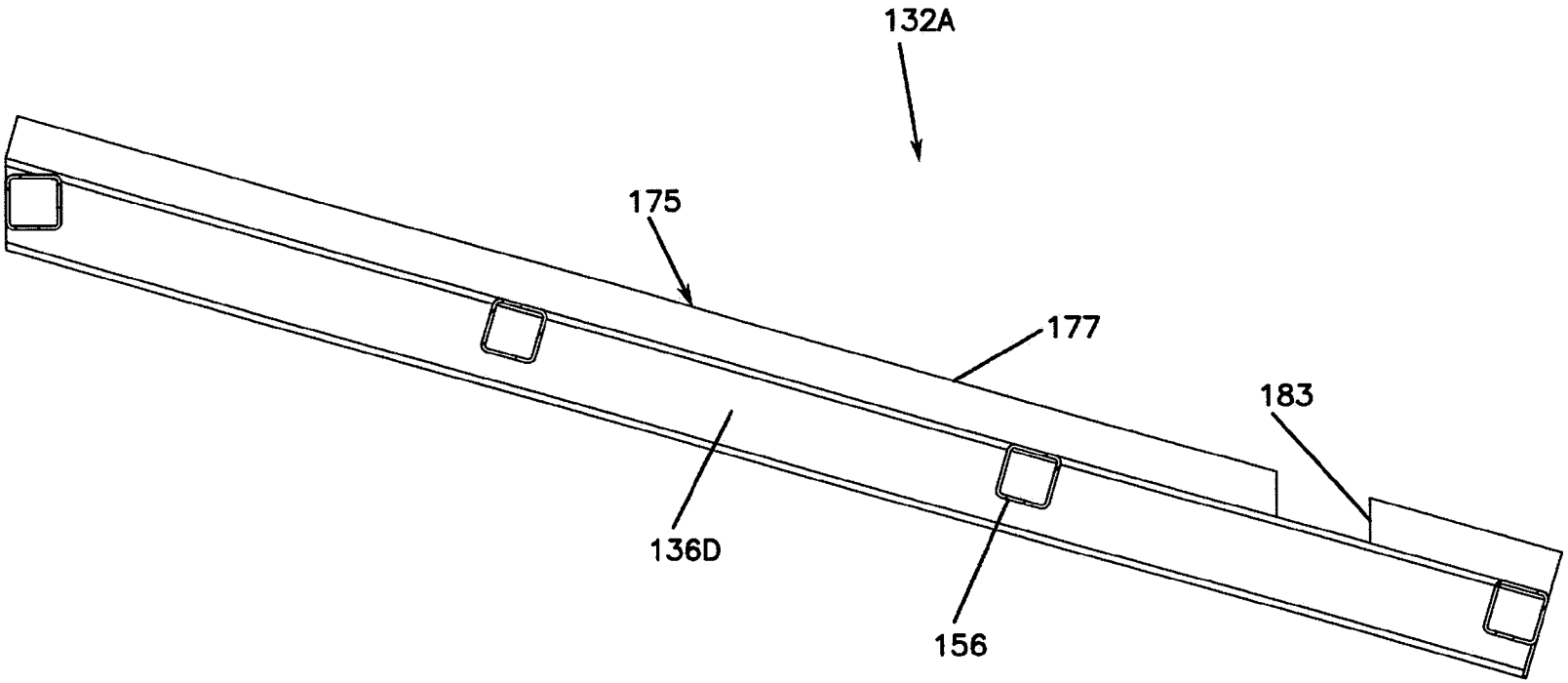
FIG. 20 is a cross-sectional view taken along section line 20-20 of FIG. 18.

Referring to FIG. 14, the rafters 136A, 136B each include thicknesses T1 and the stop plates 175 each include thicknesses T2. The thicknesses T1, T2 are measured in an orientation that extends along the slide orientation S of the second roof section 132B. In certain examples, each thickness T1 is at least 5, 10 or 15 times as large as the thickness T2.

FIGS. 17-20 show the first roof section 132A. The first roof section 132A includes first and second parallel rafters 136C, 136D and are connected by cross members 156. Stop plates 175 are mounted to outer surfaces of the rafters 136C, 136D. The rafters 136C, 136D each have a thickness T1 and the stop plates 175 each have a thickness T2. The thicknesses T1, T2 are measured in a direction along the slide orientation S. The stop plates 175 include upper portions 177 that extend above the first and second rafters 136C, 136D. At shown at FIG. 17, the stop plate 175 mounted to the second rafter 136D defines a track clearance notch 183. The stop plate 175 corresponding to the first rafter 136C defines track attachment openings 185.

Figure 21:
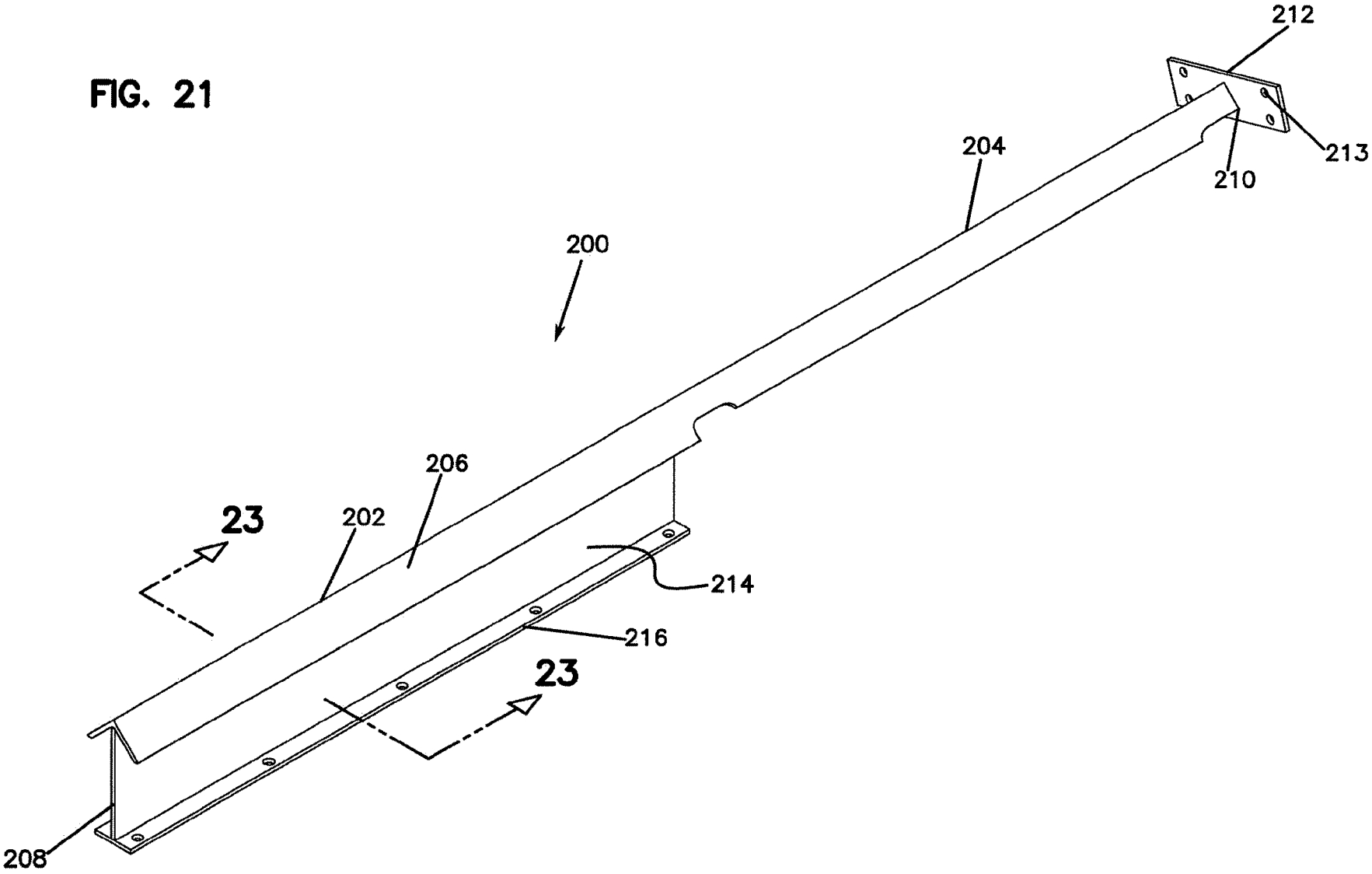
FIG. 21 is a perspective view of a section of track on which the roof section of FIG. 13 can be mounted.
Figure 22:
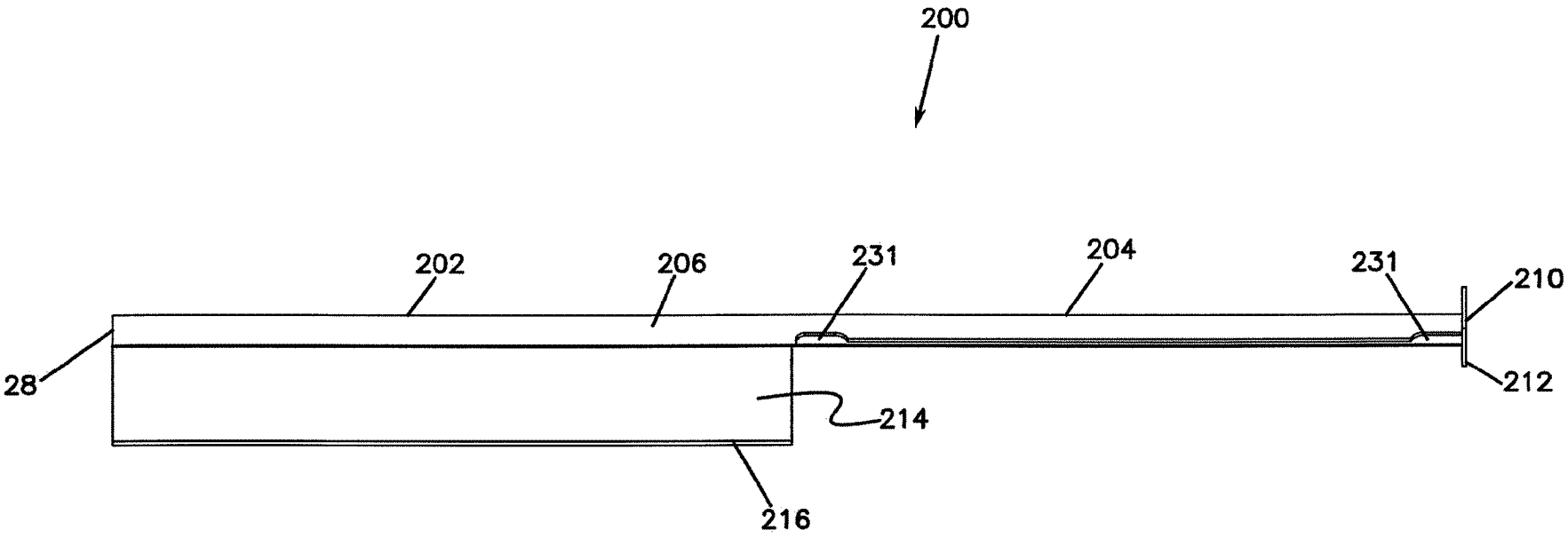
FIG. 22 is a front view of the track of FIG. 21.
Figure 23:
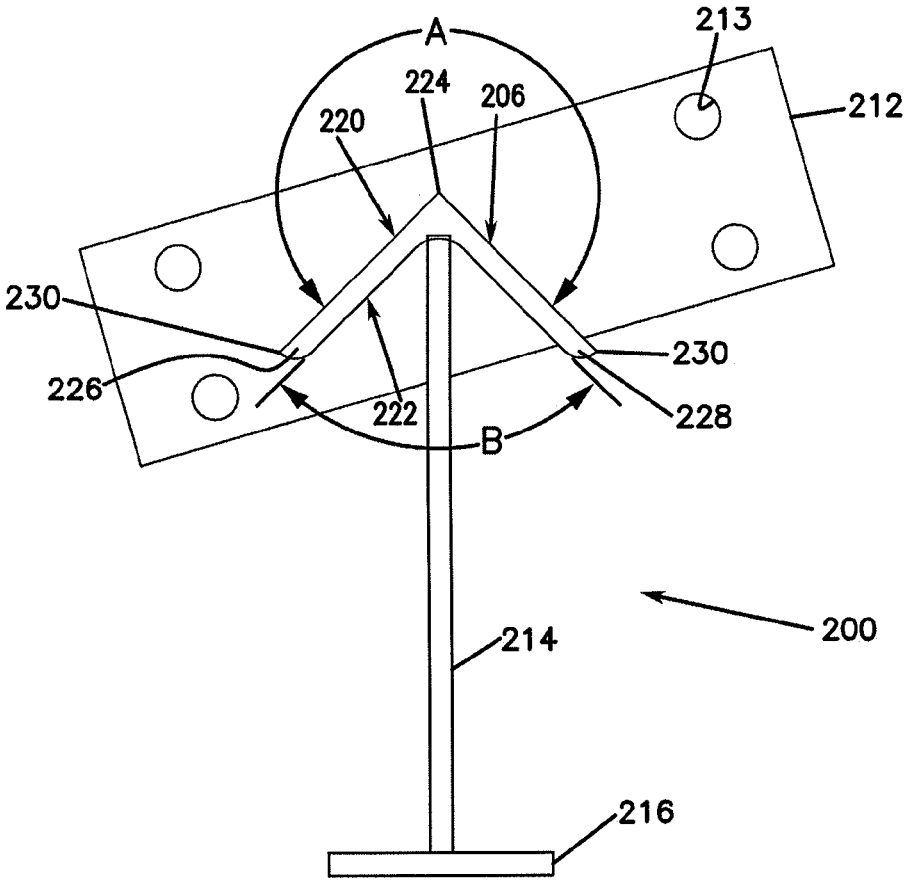
FIG. 23 is a cross-sectional view taken along section line 23-23 of FIG. 21.

FIGS. 21-23 show the track 200 in more detail. The track 200 includes an angle member 206 that extends along a length of the track 200 from a first end 208 to a second end 210. The second end 210 includes a mounting bracket 212 having openings 213 that align with the track attachment openings 185 provided within the stop plate 175 of the first rafter 136C of the first roof section 132A. Fasteners such as screws, bolts or rivets can be inserted through the openings 185, 213 to attach the second end 210 of the track 200 to the rafter 136C. The track 200 includes a stand-off 214 that supports the angle member 206 along the first portion 202 of the track 200. The stand-off 214 is used to attach the track 200 to the first longitudinal header 126A and to elevate the angle member 206 at a desired stand-off distance above the first longitudinal header 126A. In certain examples, the desired stand-off distance corresponds to a vertical dimension of the first roof section 132A. The stand-off 214 can include a lower flange 216 having openings for facilitating attaching the stand-off 214 to the first longitudinal header 126A. The second portion 204 of the track 200 does not include a stand-off. Instead, the second portion 204 of the track 200 includes the angle member 206 alone. In this way, the angle member 206 is configured to extend directly over a top side of the first roof section 132A.

Referring to FIG. 23, in one example, the angle member 206 can be formed by a standard angle-iron. The angle member 206 can include a top side 220 and a bottom side 222. The top side 220 can define a peak 224. The angle member 206 can include first and second legs 226, 228 that are interconnected at the peak 224. Top surfaces of the first and second legs 226, 228 can define an angle A that is greater than 180 degrees. Bottom surfaces of the legs 226, 228 can define an angle B that is less than 180 degrees. The stand-off 214 connects to the bottom side of the angle member 206 at a location directly beneath the peak 224. In certain examples, the bottom side of the angle member 206 can be welded to the top end of the stand-off 214. In certain examples, the angle member 206 can extend directly over the panel portion of the first roof section 132A with a slight clearance being defined between bottom edges 230 of the angle member 206 and a top side of the panel of the first roof section 132A.

FIGS. 24-26 show an example roller and hold-down configuration suitable for use with the track 200. The roller and hold-down configuration includes a roller 190 that rides on the peak 224 at the top side 220 of the angle member 206. The roller 190 can include a channel 191 that receives the peak 224. The roof sections can include hold-down structures for holding the roof sections down on the angle member 206 to prevent the roof sections from being lifted off of the track 200 by wind. The hold-down structures can include hold-down brackets 193 attached to rafters of the roof sections. The hold-down brackets 193 can include lower portions 195 that extend beneath the bottom sides 224 of the angle member 206. Interference between the lower portions 195 of the hold-down brackets 193 and the bottom side 222 of the angle member 206 prevent the roof sections from being lifted off the track 200. In one example, the hold-down brackets have an L-shaped transverse cross-section (see FIG. 26). In certain examples, hold-down brackets of a roof section can be mounted on opposite sides of each angle member 206. For example, a first hold-down bracket can extend beneath the first leg 226 of each angle member 206 and a second hold-down bracket can extend beneath the second leg 228 of each angle member 206. Notches 231 (see FIG. 22) can be provided in the angle members 206 to facilitate installing the roof sections on the track 200. The notches can provide clearance for allowing the hold-down structures to pass vertically through the legs 226, 228 during installation of the roof sections. After the hold-down brackets 193 of a roof section have passed vertically through the notches 231, the roof section can be slid horizontally along the angle member 206 such that the hold-down brackets are offset from the notches 231 and positioned beneath the legs of the angle member 206.

Figure 33:
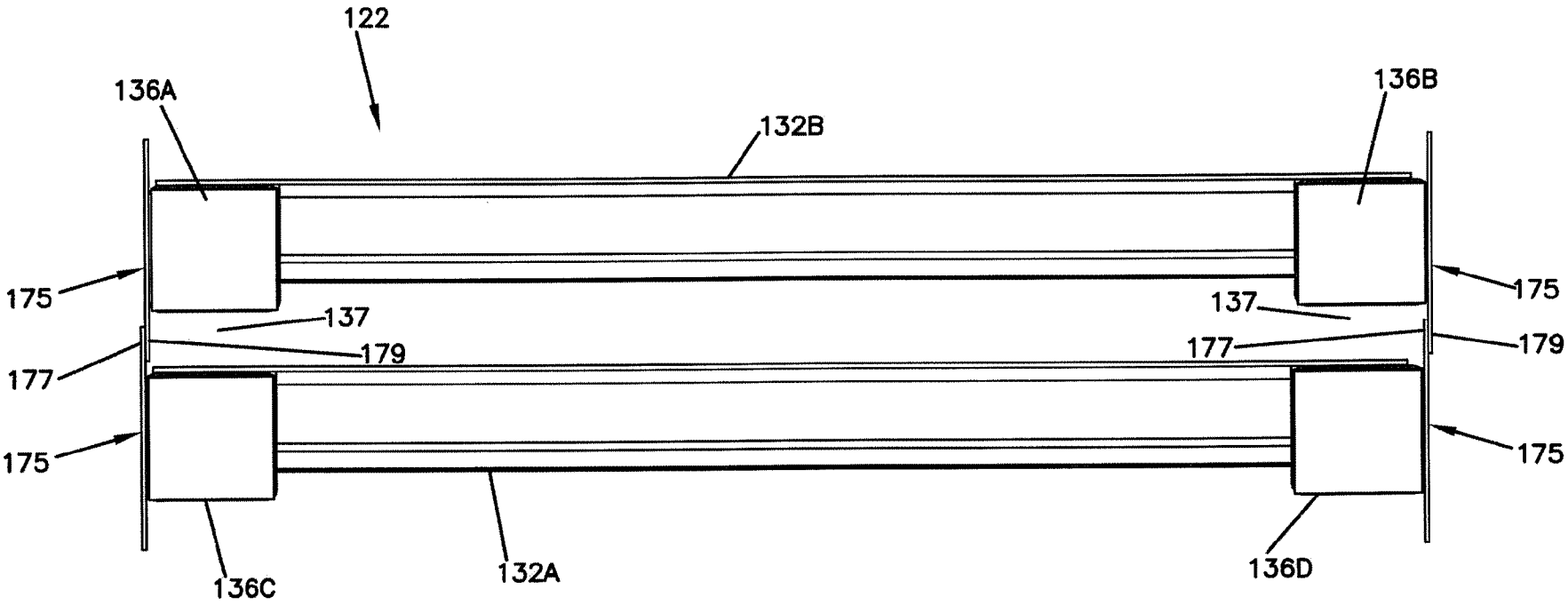
FIG. 33 shows the roof of FIGS. 11 and 12 in an open configuration.

Referring back to FIG. 12, the lower portion 179 of the stop plate 175 mounted to the rafter 136A of the second roof section 132B is captured between the upper portions 177 of the stop plates 175 mounted to the rafters 136C, 136D of the first roof section 132A. Thus, when the second roof section 132B is moved to the closed configuration of FIGS. 11 and 12, the lower portion 179 of the stop plate 175 corresponding to the rafter 136A engages the upper portion 177 of the stop plate 175 corresponding to the rafter 136D to stop relative movement between the roof sections 132A, 132B. Similarly, when the second roof section 132B is moved to the open configuration as shown at FIG. 33, the lower portions 179 of the stop plates 175 corresponding to the rafters 136A, 136B respectively engage the upper portions 177 of the stop plates 175 of the rafters 136C, 136D to stop relative movement between the roof sections 132A, 132B.

In the open configuration, an overlap region 137 exists between the rafters 136A, 136C and an overlap region also exists between the rafters 136B, 136D. For example, at least 50, 75 or 90 percent of the thickness T1 of the rafter 136A overlaps with at least 50, 75 or 90 percent of the thickness T1 of the rafter 136C. Similarly, at least 50, 75 or 90 percent of the thickness T1 of the rafter 136B overlaps with at least 50, 75 or 90 percent of the rafter 136D. The relatively large amount of overlap between the rafters is made possible by the relatively thin configuration of the stop plates 175. By overlapping the rafters, the overall aesthetic appearance of the building structure is enhanced since, when viewed from below, significant portions of the upper rafters are blocked from view by the lower rafters. This type of configuration also enhances the amount of light that can pass through the stacked roof sections when light transmissive panels are used on the roof sections.

Figure 27:
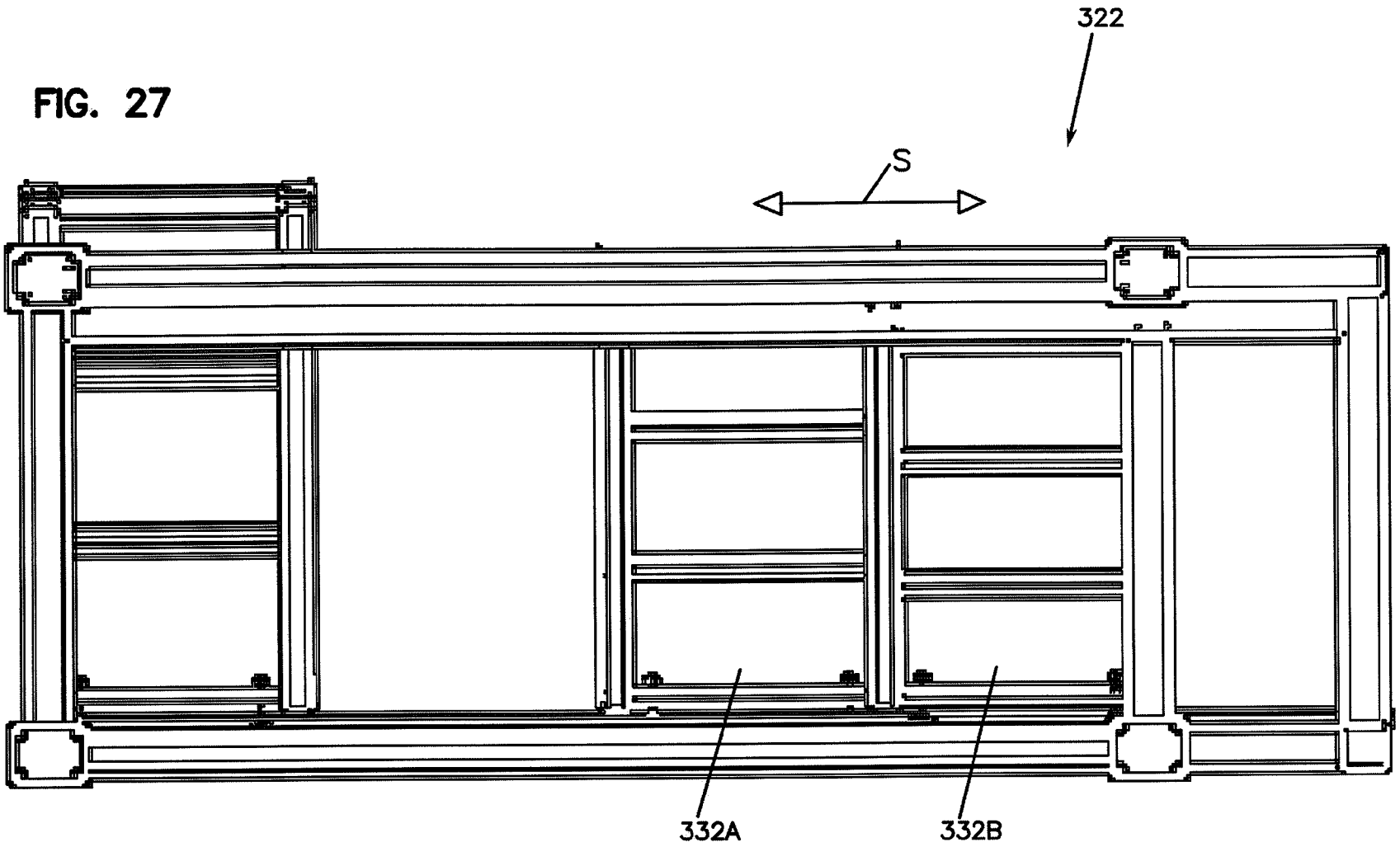
FIG. 27 is a top view of another convertible roof section in accordance with the principles of the present disclosure, the roof section is shown in an open configuration.

FIG. 27 shows another convertible roof 322 in accordance with the principles of the present disclosure. The convertible roof 322 includes first and second roof sections 332A, 332B that are moveable relative to one another along a slide orientation S. The first and second roof sections 332A, 332B are also each moveable relative to a corresponding building frame structure. While only two roof sections are depicted as being capable of being stacked, it will be appreciated that in other examples, three or more roof sections can be slid relative to one another and moved relative to one another between open and closed configurations. The three or more roof sections can all have aligned, overlapping rafters when stacked in the open configuration and can also have at least some aligned, overlapping rafters when in the closed configuration.

Figure 30:
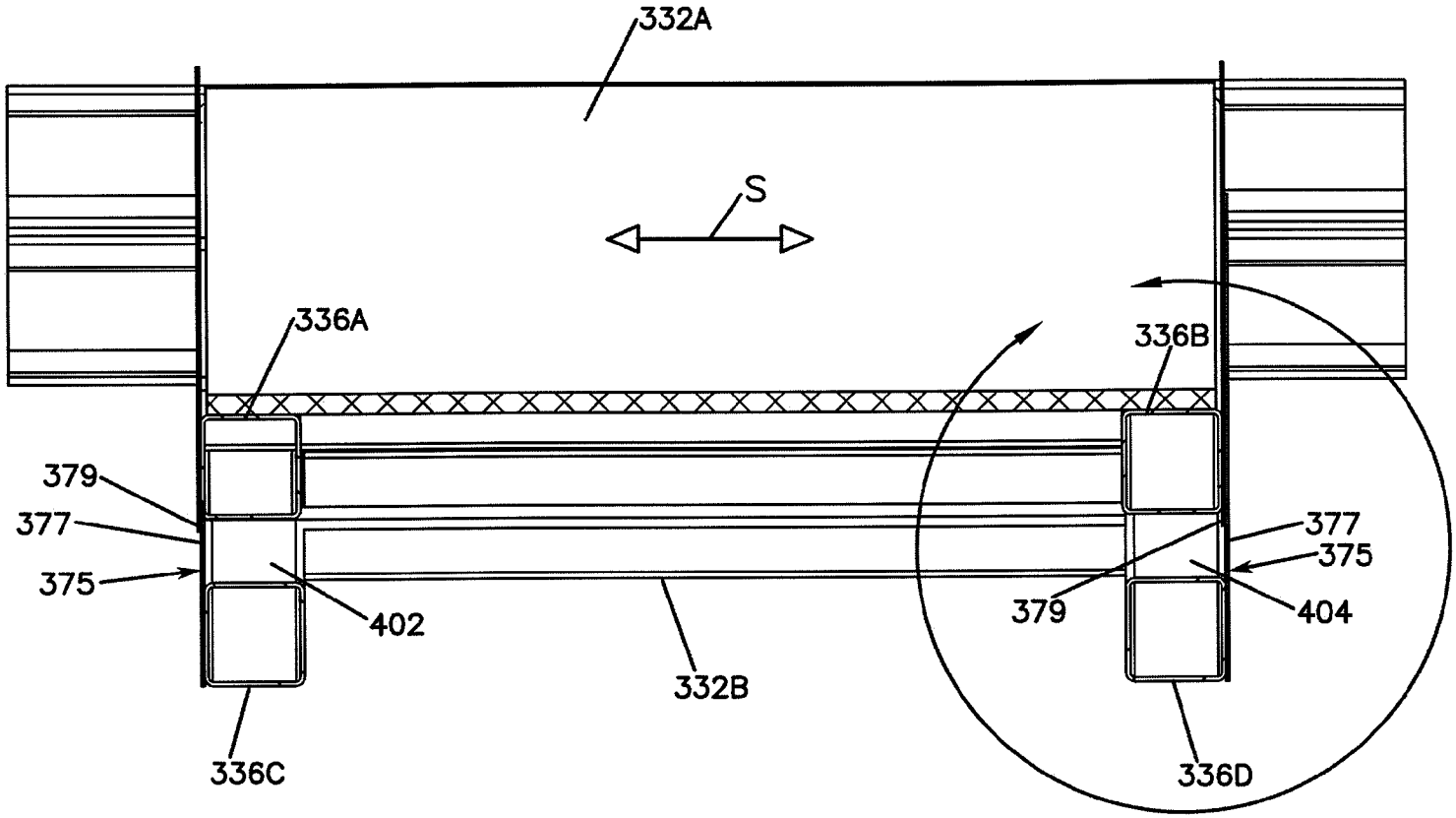
FIG. 30 is a cross-sectional view taken along section line 30-30 of FIG. 29.

Referring to FIG. 30, the first roof section 332A includes rafters 336A, 336B that are parallel and that are spaced apart along the slide orientation S. The rafters 336A, 336B each can include a thickness T1 measured along the slide orientation S. Stop structures such as relatively thin members 375 (e.g., plates) can be carried with the rafters 336A, 336B. In the depicted embodiment, the stop structures 375 are mounted at outer surfaces of the rafters 336A, 336B and include lower portions 379 that project downwardly beyond lower surfaces of the rafters 336A, 336B. Still referring to FIG. 30, the second roof section 332B is adapted to fit beneath the first roof section 332A and includes parallel rafters 336C, and 336D. The rafters 336C, 336D each have a thickness T1 measured along the slide orientation. The rafters 336C, 336D can be spaced apart from one another along the slide orientation S. Stop structures 375 are carried with the rafters 336C, 336D. As depicted at FIG. 30, the stop structures 375 are mounted at outer surfaces of the rafters 336C, 336D and have upper portions 377 that project upwardly beyond upper surfaces of the rafters 336D, 336D.

Figure 28:
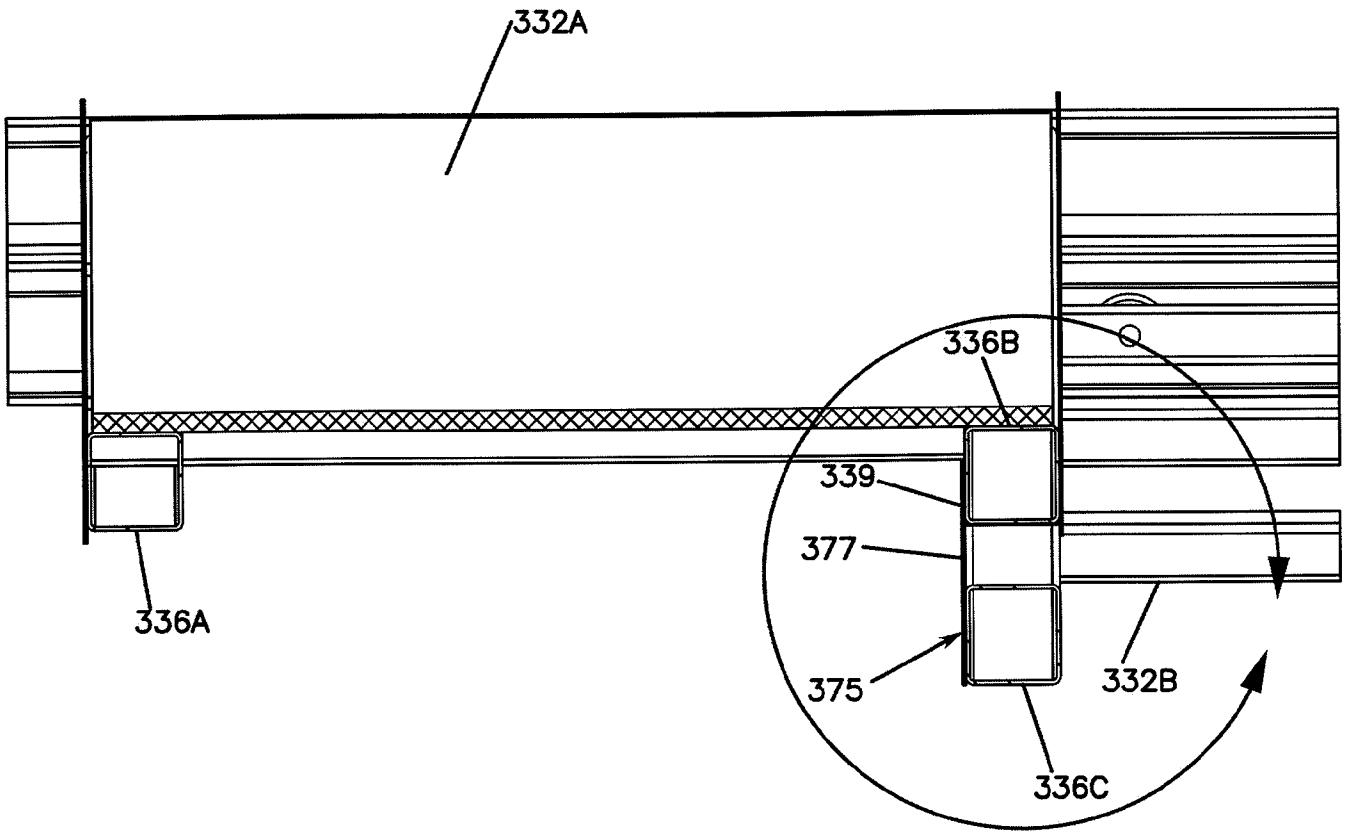
FIG. 28 is a cross-sectional view taken along section line 28-28 of FIG. 27.
Figure 28A:
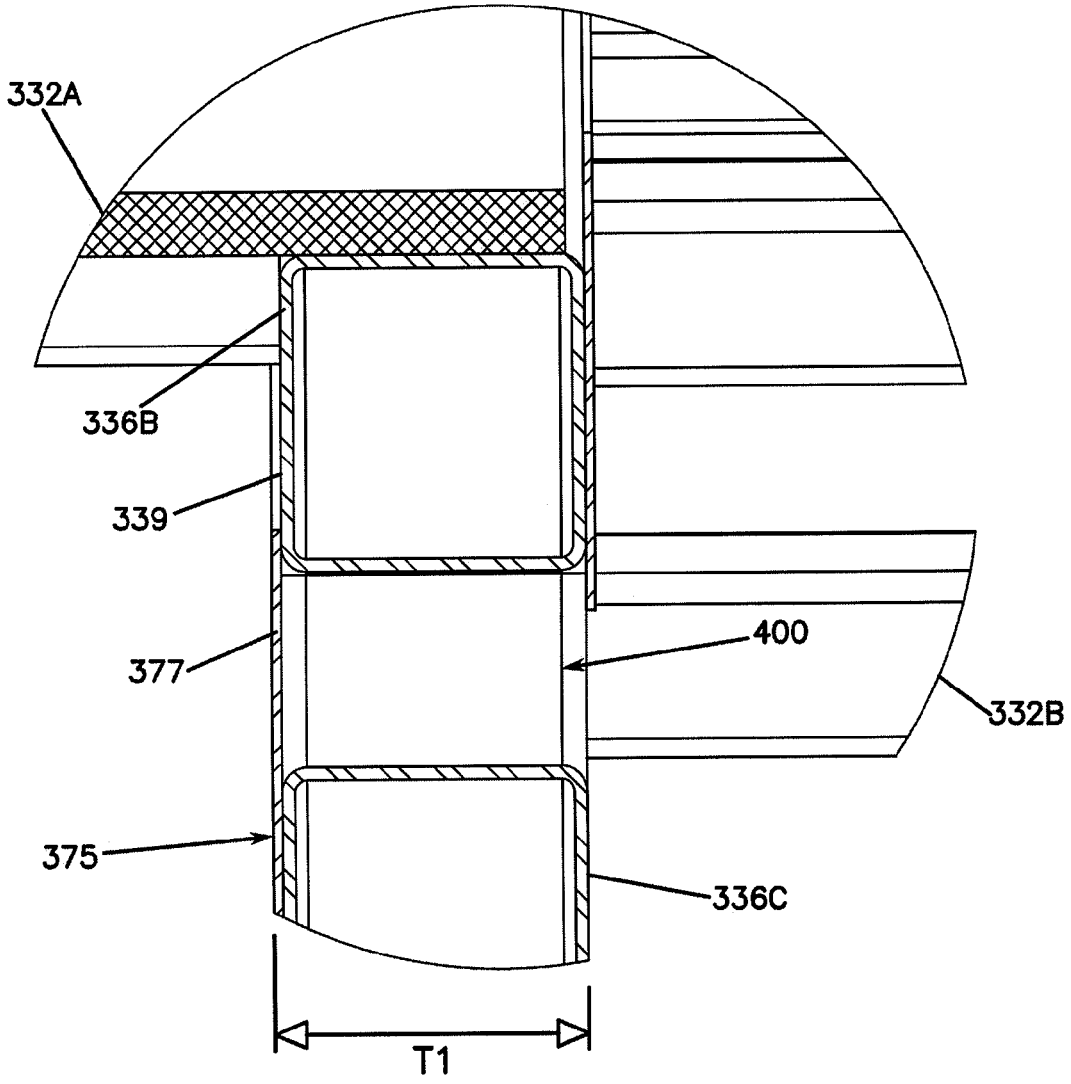
FIG. 28A is an enlarged view of a portion of FIG. 28.

When the roof sections 332A, 332B are moved to a closed configuration (see FIGS. 27, 28 and 28A), the upper portion 377 of the stop structure 375 carried with the rafter 336C of the second roof section 332B abuts against an inner side 339 of the rafter 336B of the first roof section 332A to limit or stop relative movement between the roof sections 332A, 332B (see FIG. 28A). With the roof sections 332A, 332B moved to the closed configuration, an overlap region 400 is defined between the rafter 336C of the second roof section 332B and the rafter 336B of the first roof section 332A. At least 50, 75 or 90 percent of the thickness T1 of the rafter 336C coincides with the overlap region 400. Similarly, at least 50, 75 or 90 percent of the rafter 336B coincides with the overlap region 400. The thicknesses T1 of the rafters 336A, 336B, 336C and 336D can be at least 5, 10 or 15 times larger than the corresponding thicknesses T2 of the stop structures 375. The relatively thin size of the stop structures 375 allows substantial overlap between rafters 336C, 336B in the closed configuration.

Figure 29:
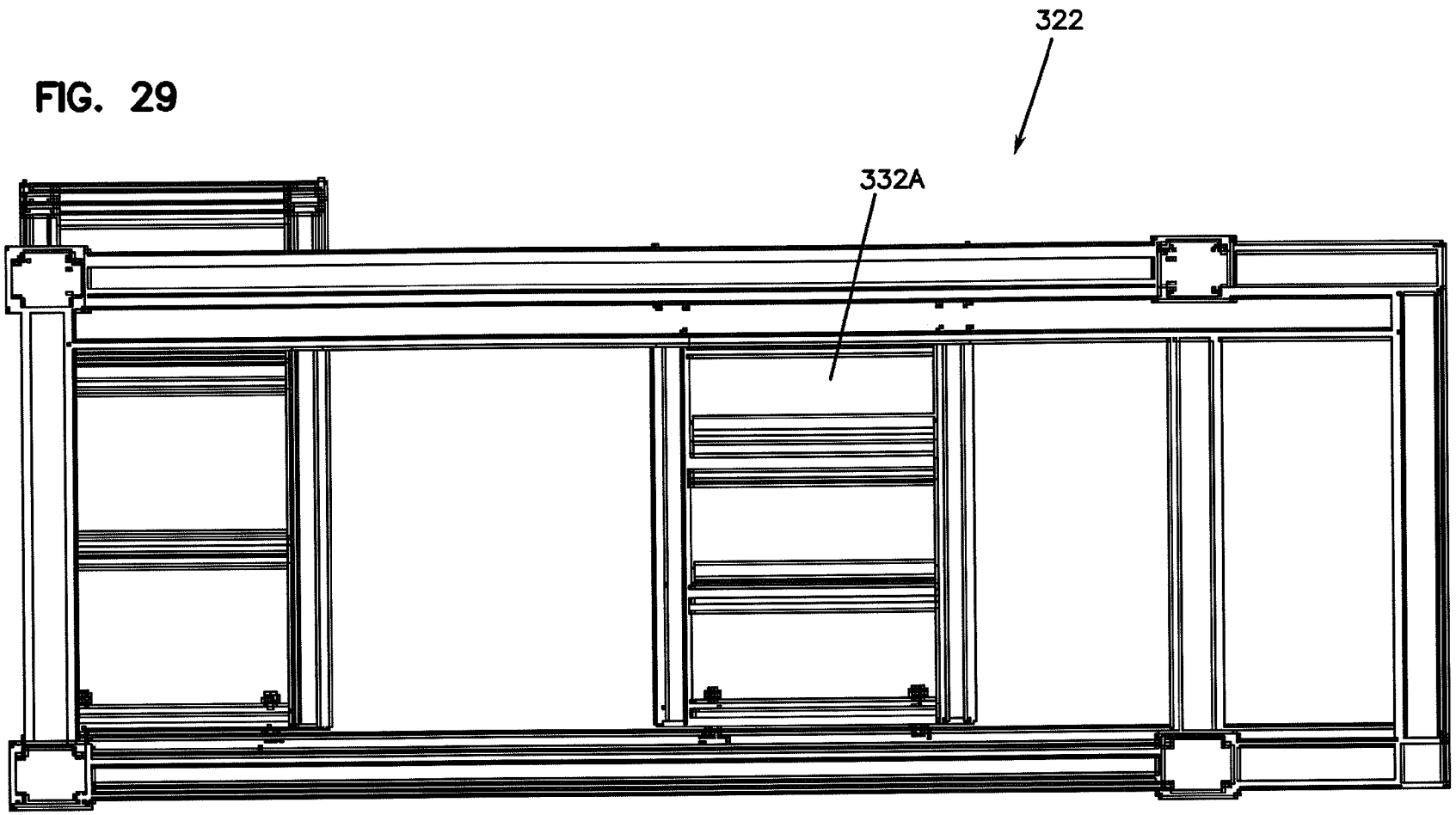
FIG. 29 is a top view showing the convertible roof of FIG. 27 with the roof sections in an open configuration.
Figure 30A:
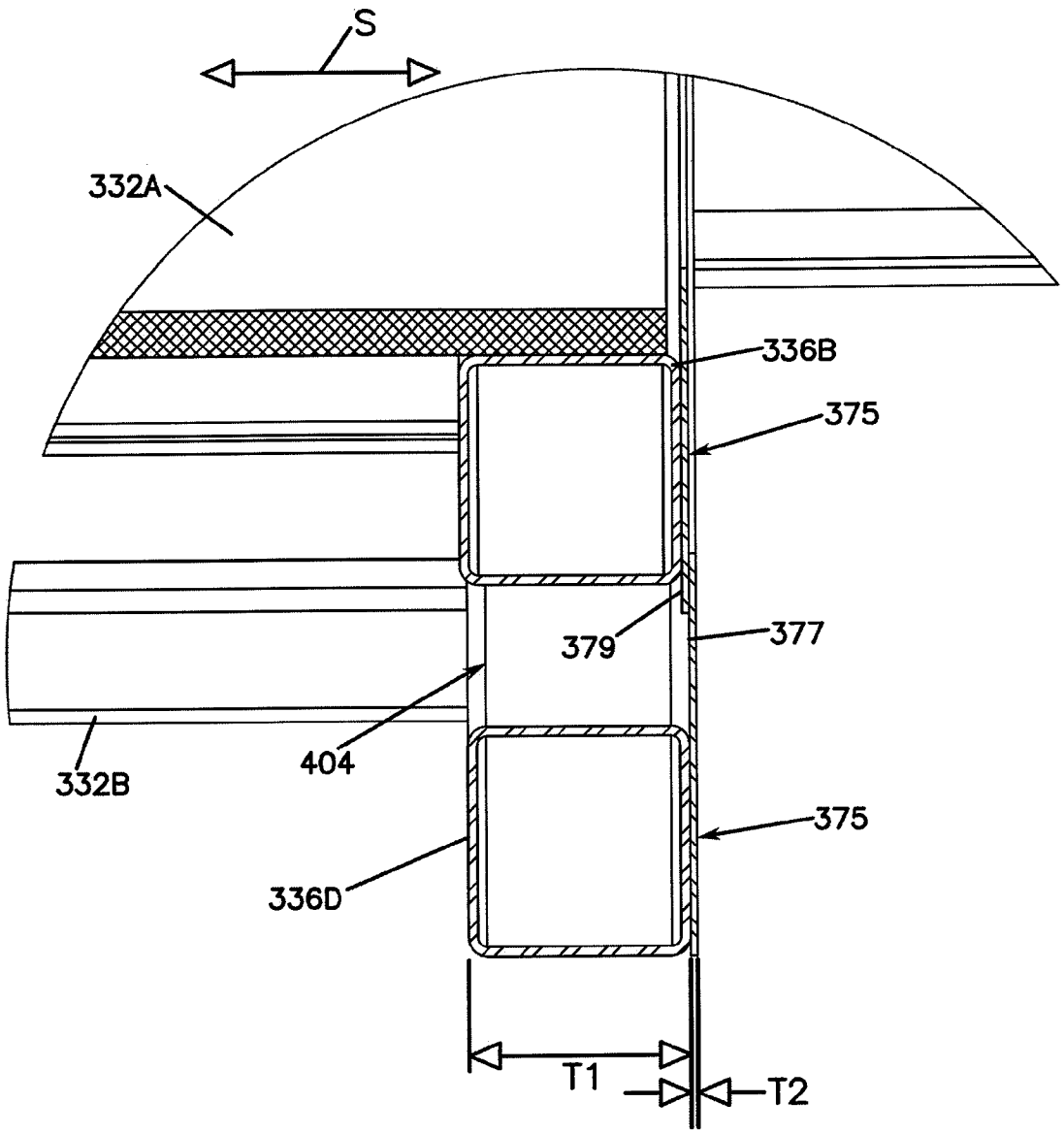
FIG. 30A is an enlarged view of a portion of FIG. 30.

FIGS. 29, 30 and 30A show the first and second roof sections 332A, 332B in an open configuration. As shown at FIG. 30A, in the open configuration, the upper portion 377 of the stop structure 375 carried with the rafter 336D of the second roof section 332B abuts against the lower portion 379 of the stop structure 375 carried with the rafter 336B of the first roof structure 332A to stop relative movement between the first and second roof sections 332A, 332B. Similarly, the upper portion 377 of the stop structure 375 carried with the rafter 336C of the second roof section 332B can abut against the lower portion 379 of the stop structure 375 carried by the rafter 336A of the first roof section 332A. It will be appreciated that the bottom of the rafter 336A can be notched, elevated or include other structure for allowing the upper portion 377 of the stop structure 375 carried with the rafter 336C to move past the main body of the rafter 336A to reach the lower portion 379 of the stop structure 375 mounted to the rafter 336A. In one example, the rafter 336A can have a smaller height than the rafter 336B so that the bottom of the rafter 336A is elevated relative to the bottom of the rafter 336B and therefore does not interfere with the stop structure 325 of the rafter 336C. In other embodiments, the upper portion 377 of the stop 375 of the rafter 336C can be non-continuous (e.g., it does not extend along the full length of the rafter 336C) and can align with a notch in the lower side of the rafter 336A. In still other embodiments, the stop 375 carried with the rafter 336C can abut the inner side of the rafter 336A such that no overlap region is provided between the rafters 336A, 336C when the roof is in the open position.

In the open configuration of FIG. 30, an overlap region 402 is defined between the rafters 336A and 336C and an overlap region 404 is defined between the rafters 336B and 336D. In one example, at least 50, 75 or 90 percent of the thicknesses T1 of the rafters 336A, 336C coincide with the overlap region 402 when the roof sections 332A, 332B are in the open configuration. Similarly, at least 50, 75 or 90 percent of the thicknesses T1 of the rafters 336B and 336C coincide with the overlap region 404 when the roof section 332A, 332B are in the open configuration.

Figure 31:
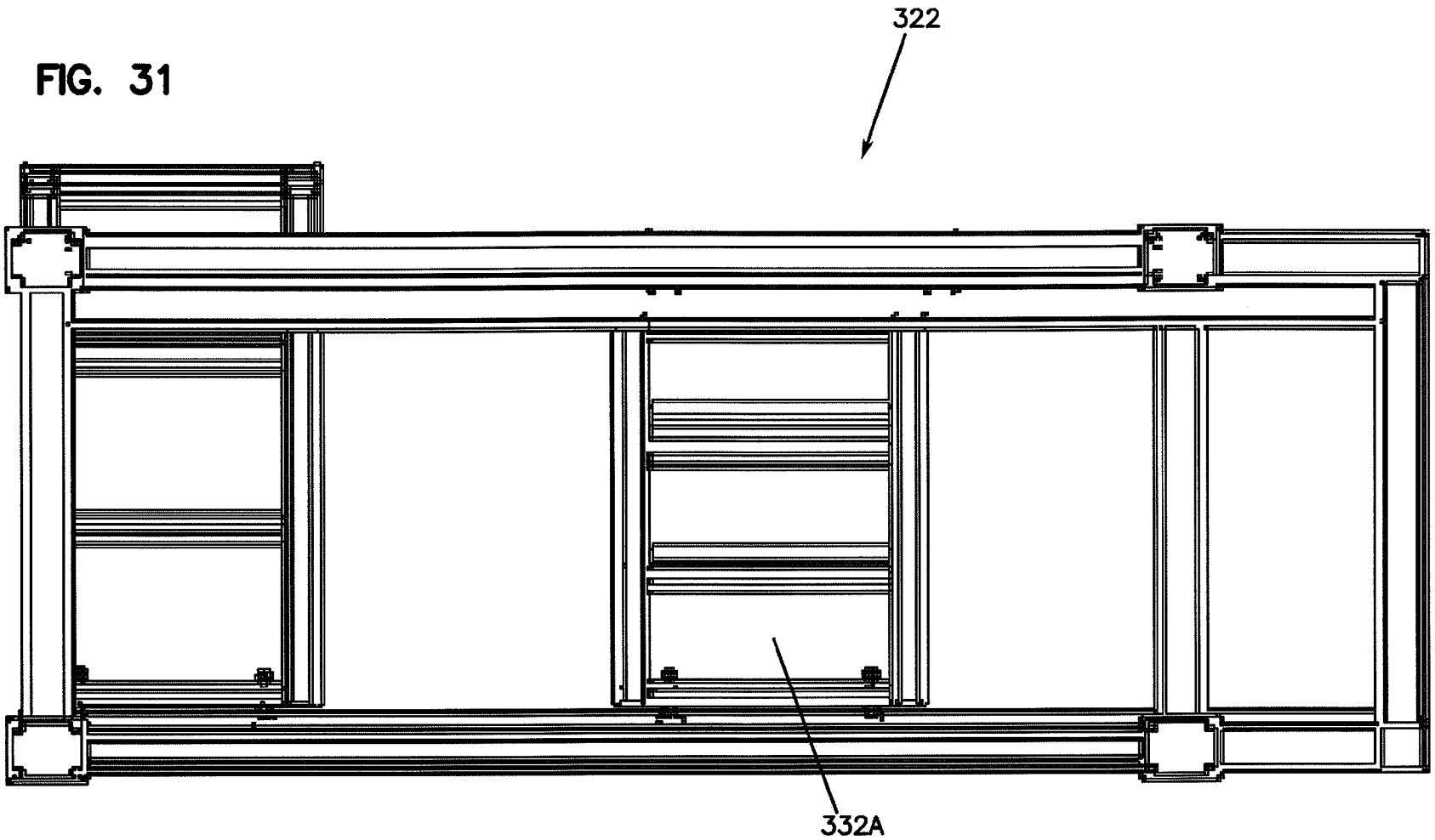
FIG. 31 is a top view showing the convertible roof of FIG. 27 is a partially open configuration.
Figure 32:
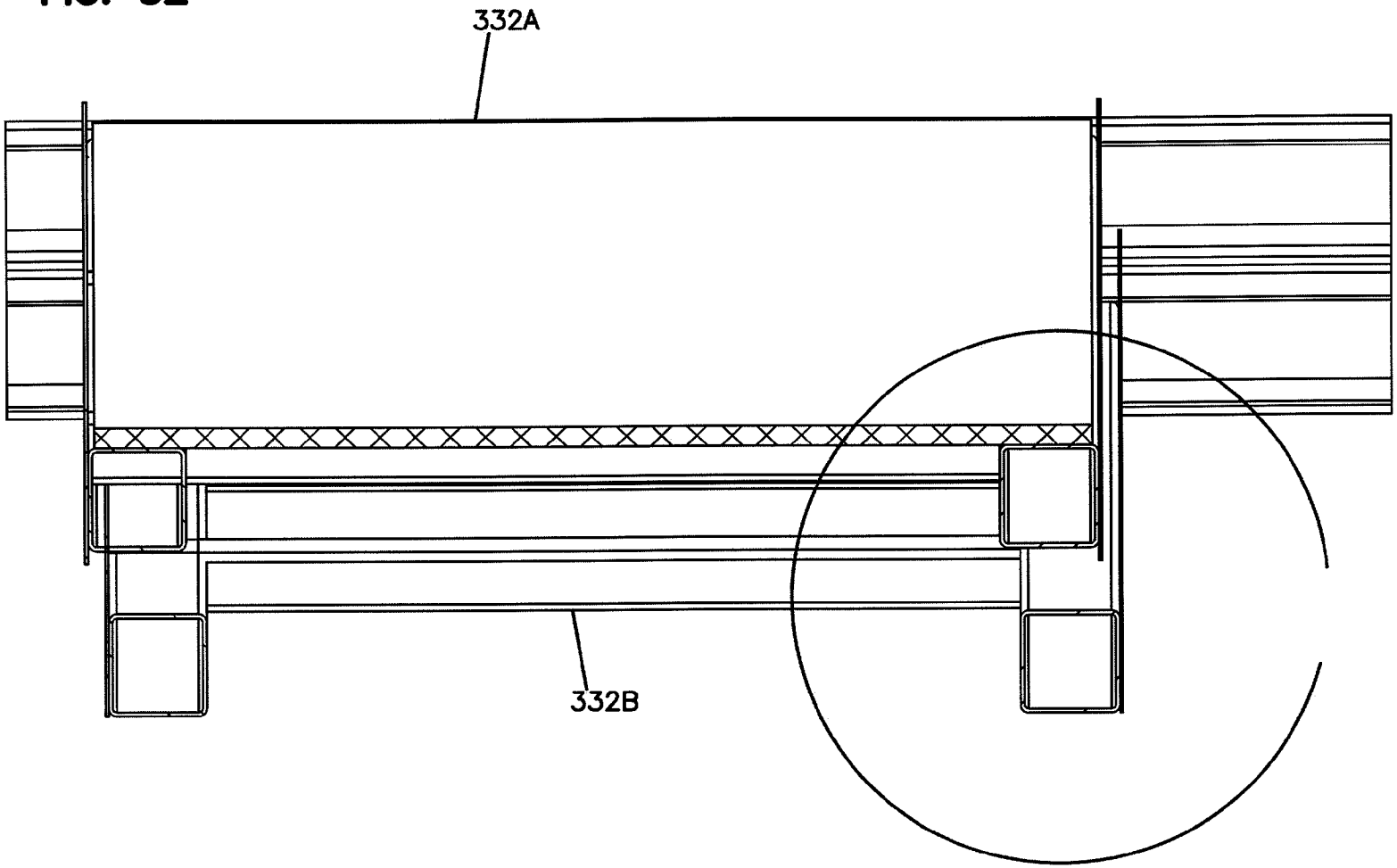
FIG. 32 is a cross-sectional view taken along section line 32-32 of FIG. 31.
Figure 32A:
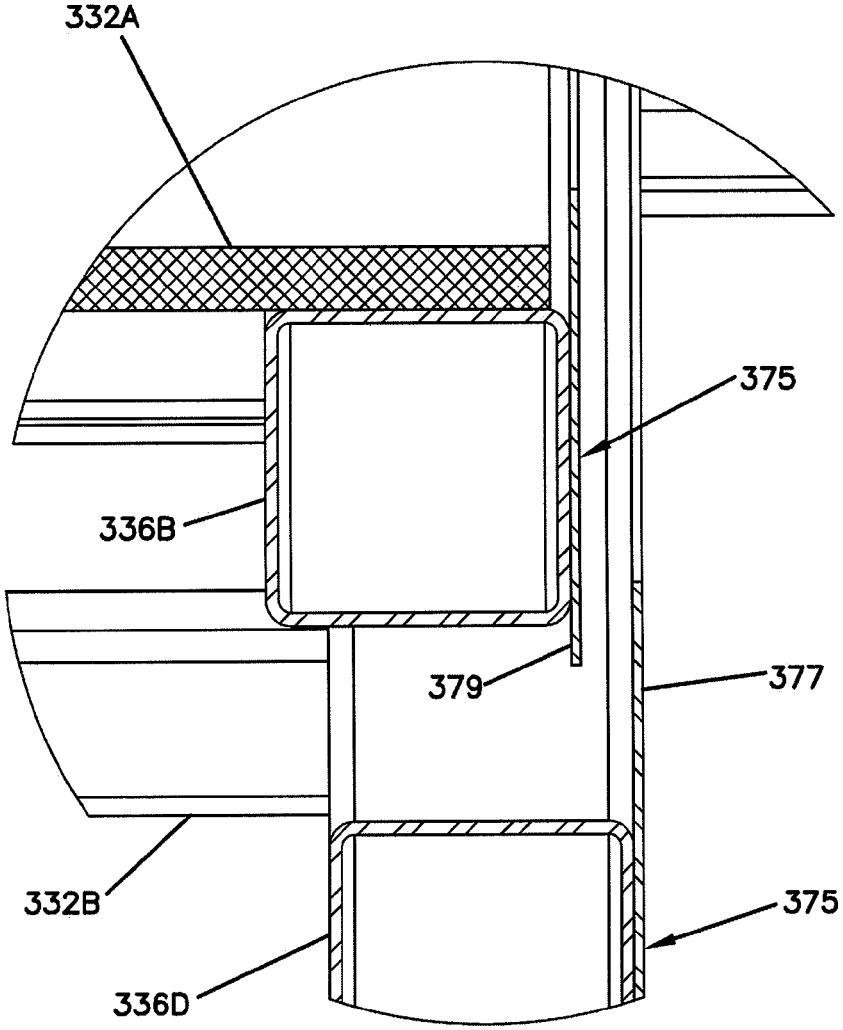
FIG. 32A is an enlarged view of a portion of FIG. 32.

FIGS. 31, 32 and 32A show the roof sections 332A, 332B in an intermediate orientation in which the roof sections 332A, 332B are in the process of being moved between the open and closed configurations.

What is claimed is:

1. A building structure having a roof that is convertible between an open configuration and a closed configuration, the building structure comprising:

a primary frame structure that defines a structure length and a structure width, the primary frame structure including a longitudinal header that extends along the structure length and cross-headers that extend along the structure width, the cross-headers being positioned below the longitudinal header at opposite first and second ends of the primary frame structure, the longitudinal header being connected to the cross-headers at the first and second ends of the primary frame structure, and the primary frame structure further including columns that support the longitudinal header and the cross-headers at an elevated position above the ground;

a plurality of roof sections mounted on the primary frame structure, the roof sections each including a roof panel having a panel length that extends along the structure width and a panel width that extends along the structure length, the roof sections including panel frames that support the panels, the panel frames including primary frame members that support longitudinal edges of the panels, the primary frame members extending along the panel lengths and being positioned on opposite sides of the panel widths, the roof sections including main portions that cover an interior space defined by the primary frame structure, the roof sections also including overhang portions that project outwardly past the longitudinal header, the overhang portions cooperating to form a continuous overhang when the roof is in the closed configuration, the continuous overhang projecting outwardly from the longitudinal header and having an overhang length that extends along the structure length;

the plurality of roof sections including first and second stationary roof sections mounted to the primary frame structure adjacent the first and second ends of the primary frame structure, the first and second stationary roof sections including the overhang portions;

the plurality of roof sections including first and second movable roof sections slidably mounted relative to the primary frame structure along a slide axis that extends along the structure length, the first and second movable roof sections covering a central portion of interior space of the building structure when the roof is in the closed configuration, the first and second movable roof sections overlapping respectively overlapping majorities of the first and second stationary roof sections when the roof is in the open configuration such that the central portion of the interior space is uncovered, the first and second movable roof sections including the overhang portions; and a track that slidably supports the first and second movable roof sections, the track extending along the longitudinal header between the first and second ends of the primary frame structure, the track including first portions that extend across the first and second stationary roof sections at locations above the panels of the first and second stationary roof sections, wherein the first and second movable roof sections ride on the first portions of the track when the roof is moved between the open and closed configurations.

2. The building structure of claim 1, wherein the continuous overhang prevents water from draining onto the longitudinal header and eliminates the need for gutters along the longitudinal header.

3. The building structure of claim 1, wherein the roof sections are pitched upwardly as the roof sections extend along the structure width in a direction away from the overhang portions, and wherein the first portions of the track are spaced from top sides of the panels of the first and second stationary roof sections such that water can flow between the top sides of the panels and the first portions of the track from the main portions of the stationary roof sections to the overhang portions of the stationary roof sections.

4. The building structure of claim 1, wherein the track includes a second portion that extends along the longitudinal header between the first portions, the second portion coinciding with the central portion of the interior space of the building structure.

5. The building structure of claim 4, wherein the second portion of the track is supported on a filler that elevates the track relative to the longitudinal header and that assists in filling a gap between a top side of the longitudinal header and bottom sides of the panels of the movable roof sections.

6. The building structure of claim 5, wherein the filler has a height that equals a distance from a top side of the header to top sides of the panels of the stationary roof sections.

7. The building structure of claim 5, wherein the panel frames of the roof sections include cross-members that are attached to the primary frame members of the roof sections and that extend across widths of the panels at locations below the panels.

8. The building structure of claim 7, wherein first cross-members of the panel frames of the movable roof sections are positioned adjacent to the filler and cooperate with the filler to fill the gap between the top side of the longitudinal header and the bottom sides of the panels of the movable roof sections.

9. The building structure of claim 8, wherein the primary frame members of the panel frames of the stationary roof sections include notches that receive portions of the longitudinal header such that bottom sides of the panels of the stationary roof sections are lowered relative to the top side of the longitudinal header, and wherein first cross-members of the panel frames of the stationary roof sections are positioned adjacent to the top side of the longitudinal header to fill a gap between the top side of the longitudinal header and the bottom sides of the stationary roof sections.

10. The building structure of claim 9, wherein the primary frame members of the panel frames of the movable roof sections define lower notches that receive the track to allow the movable roof sections to slide along and be guided by the track.

11. The building structure of claim 10, further comprising low-friction members mounted within the notches to facilitate sliding the movable roof sections along the track.

12. The building structure of claim 11, wherein the first portions of the track are attached to the primary frame members of the panel frames of the stationary roof sections, and wherein the first portions bridge a distance across the widths of the stationary roof sections between the primary frame members.

13. The building structure of claim 12, wherein the primary frame members of the stationary roof sections include first primary frame members that are closest to the central portion of the interior space, and wherein the track extends through the first primary frame members.

14. The building structure of claim 1, wherein the panels of the roof sections are transparent or opaque or translucent.

15. The building structure of claim 1, wherein the overhang portions of the roof sections have a cantilevered configuration with unsupported free ends.

16. The building structure of claim 15, wherein the overhang portions overhang the longitudinal header by at least 6 inches.

17. The building structure of claim 15, wherein the overhang portions overhang the longitudinal header by at least 12 inches.

18. The building structure of claim 15, wherein the overhang portions overhang the longitudinal header by at least 18 inches.

* * * * *